United States Patent [19]

Wakatake

[11] Patent Number: 5,045,767

[45] Date of Patent: Sep. 3, 1991

[54] ROTATING DISPLAY ELEMENT AND DISPLAY UNIT USING THE SAME

[76] Inventor: Yoshimasa Wakatake, 26-11 Kamiyoga 5-chome, Setagaya-ku, Tokyo 158, Japan

[21] Appl. No.: 420,149

[22] Filed: Oct. 11, 1989

[30] Foreign Application Priority Data

Oct. 12, 1988 [JP] Japan ..... 63-256104

[51] Int. Cl.[5] ..... G09F 11/00

[52] U.S. Cl. ..... 318/696; 318/40; 318/49; 318/103; 318/112

[58] Field of Search ..... 340/783, 806, 811; 310/187; 318/696, 685, 672, 671, 490, 436, 112, 103, 102, 49, 45, 40, 39

[56] References Cited

U.S. PATENT DOCUMENTS

| | | | |
|---|---|---|---|
| 4,509,864 | 4/1985 | Oellig et al. | 368/108 |
| 4,558,267 | 12/1985 | Wakatake | 318/696 |
| 4,926,167 | 5/1990 | Jenkins et al. | 340/764 |

*Primary Examiner*—Bentsu Ro

*Attorney, Agent, or Firm*—Sixbey, Friedman, Leedom & Ferguson

[57] ABSTRACT

A rotating display element which is provided with a display surface member having four display surfaces which are selected by rotating the display surface member, and a display unit which uses the display element. The display surface member has incorporated therein a permanent magnet type motor mechanism and is driven by the permanent magnet type motor mechanism. The rotor of the motor mechanism has first and second double-pole permanent magnet members, and its stator has first and second magnetic members having wound thereon first and second exciting windings, respecitvely. The display unit has first and second power supply means for supplying power to the first exciting winding motor mechanism and third and fourth power supply means for supplying power to the second exciting windings. The four display surfaces of the display surface member can selectively be directed to the front by supplying power to the first exciting winding via the first or second power supply means and by supplying power to the second exciting winding via the third or fourth power supply means. A display panel can be constituted by arranging, in a matrix form, a number of such display units each employing the rotating display element.

2 Claims, 10 Drawing Sheets

ROTATING DISPLAY ELEMENT AND DISPLAY UNIT USING THE SAME

BACKGROUND OF THE INVENTION

1. Field of the Invention

The present invention relates to improvement in a rotating display element which is provided with a display surface member having four display surfaces and is adapted to select a desired one of the display surfaces by rotating the display surface member. Further, the invention pertains to improvement in a display unit using such a rotating display element.

2. Description of the Prior Art

The inventor of this application has proposed a rotating display element and a display unit using the same in Japanese Patent Application No. 219,803/85 (Japanese Patent Public Disclosure Gazette No. 79,495/87).

The rotating display element disclosed in the above prior application has a display surface member having four display surfaces and a permanent magnet type motor mechanism. The display surface member is mounted on rotor of the permanent magnet type motor mechanism housed therein, and the four display surfaces of the display surface member are arranged side by side around the axis of the rotor.

Either one of the rotor and the stator of the permanent magnet type motor mechanism has first and second double-pole permanent magnet members respectively having north and south magnetic poles and disposed side by side in the axial direction of the rotor.

The first double-pole permanent magnet member is a bar- or plate-like member of a narrow rectangular cross section in a direction perpendicular to the axis of the rotor and magnetized with north and south magnetic poles at its both free end faces spaced an angular distance of 180 degree apart around the axis of the rotor. The bar- or plate-like member is mounted on the rotor shaft, with the center of the former in the above cross section held with the center of the latter. The second double-pole permanent magnet member is also a bar- or plate-like member which of a narrow rectangular cross section in the direction perpendicular to the axis of the rotor and magnetized with north and south magnetic poles at its both free end faces spaced an angular distance of 180 degrees apart around the axis of the rotor. The bar- or plate-like member is mounted on the rotor shaft, with the center of the former in the above cross section held in agreement with the center of the latter. The north and south magnetic poles of the second double-pole permanent magnet member are disposed around the axis of the rotor at an angular distance of $\pm\alpha^\circ$ (where $0^\circ \leqq \alpha^\circ < 180^\circ$) from the north and south magnetic poles of the first double-pole permanent magnet member and at an angular distance of 180 degrees from each other.

The other of the rotor and the stator of the permanent magnet type motor mechanism has a first magnetic member provided with first and second magnetic poles which act on the north and south magnetic poles of the first double-pole permanent magnet member, a second magnetic member provided with third and fourth magnetic poles which act on the north and south magnetic poles of the second double-pole permanent magnet member, a first exciting winding wound on the first magnetic member in manner to excite its first and second magnetic poles in reverse polarities, and a second exciting winding wound on the second magnetic member in a manner to excite its third and fourth magnetic poles in reverse polarities. The first and second magnetic poles of the first magnetic member are disposed at an angular distance of 180 degrees around the axis of the rotor. The third and fourth magnetic poles of the second magnetic member are disposed around the axis of the rotor at an angular distance of $\pm 90^\circ \pm\alpha^\circ$ from the first and second magnetic poles of the first magnetic member and at an angular distance of 180 degrees from each other. The first and second magnetic poles of the first magnetic member and the third and fourth magnetic poles of the second magnetic member respectively extend over an angular range of about 90 degrees around the axis of the rotor.

The display unit set forth in the aforementioned prior application has the above-described rotating display element and a drive unit therefor.

The drive unit has first power supply means for supplying power to the first exciting winding so that the first and second magnetic poles of the first magnetic member are magnetized with the north and south magnetic poles, second power supply means for supplying power to the first exciting winding so that the first and second magnetic poles of the first magnetic member are magnetized with the south and north magnetic poles, third power supply means for supplying power to the second exciting winding so that the third and fourth magnetic poles of the second magnetic member are magnetized with the north and south magnetic poles, and fourth power supply means for supplying power to the second exciting winding so that the third and fourth magnetic poles of the second magnetic member are magnetized with the south and north magnetic poles.

According to the above-described rotating display element, a selected one of the display surfaces of the display surface member can be turned to the front display position, simply by supplying power in desired polarity to the first and second exciting windings of the stator (or rotor) of the motor mechanism. This permits simplification of the arrangement for driving the display surface member to bring a selected one of its display surfaces to the front display position.

Even if the power supply to the first and second exciting windings is cut off after turning a selected one of display surfaces to the front display position, the selected display surface can be held there, because the first and second double-pole permanent magnet members of the rotor (or stator) of the motor mechanism still act on the first and second magnetic members of the stator (or rotor). This saves unnecessary power consumption.

Since the motor mechanism is housed in the display surface member, a display surface member driving mechanism need not be provided separately of the display element.

Further, since the display element has the afore-mentioned arrangement in which the rotor (or stator) of the motor mechanism has the first and second double-pole permanent magnet members each magnetized with north and south magnetic poles, the double-pole permanent magnet members are each formed by a bar- or plate-like member of a narrow rectangular cross section in the direction perpendicular to the axis of the rotor and has the north and south magnetic poles at its both free end faces spaced an angular distance of 180 degrees apart around the axis of the rotor, and the bar- or plate-like member is mounted on the rotor shaft, with the center of the former in the above-mentioned cross section held in agreement with the center of the latter, it is possible to rapidly and smoothly turn a selected display surface to the front display position and hold it there accurately.

The display unit described above employs the above-mentioned display element and the drive unit therefor including the first and second power supply means for the first and second exciting windings of the display element and the third and fourth power supply means for the second exciting winding. The display surface member can be driven to bring a desired one of the display surfaces to the front display position, simply by selecting the corresponding one of the first to fourth power supply means. Thus, the display element can be driven with a simple arrangement.

In the rotating display element described above, since the intensity of magnetization of the first and second magnetic poles of the first magnetic member and the third and fourth magnetic poles of the second magnetic member can be heightened by increasing the power supply to the first and second exciting windings, a large torque develops in the display surface member when it is driven, and consequently, a selected one of the display surfaces can be quickly brought to the front display position.

In this instance, however, since the first and second magnetic poles of the first magnetic member and the third and fourth magnetic poles of the second magnetic member each extend over as wide an angular range as 90 degrees or so about the axis of the rotor, the high-intensity magnetization of the first to fourth magnetic poles over their entire angular ranges calls for a sufficiently high power supply to the first and second exciting windings, inevitably resulting in a large power consumption.

SUMMARY OF THE INVENTION

It is therefore an object of the present invention to provide a novel rotating display element free from the above-mentioned defect and a display unit using such a rotating display element.

The rotating display element of the present invention is identical in construction with the above-described display element except that the north and south magnetic poles of the first and second double-pole permanent magnets each extend over an angular range of around 90 degrees about the axis of the rotor and that the first and second magnetic poles of the first magnetic member and the third and fourth magnetic poles of the second magnetic member each extend over an angular range of 45 degrees or less about the axis of the rotor.

The display unit of the present invention is identical in construction with the above-described display unit except that the north and south magnetic poles of the first and second double-pole permanent magnets each extend over an angular range of around 90 degrees about the axis of the rotor and that the first and second magnetic poles of the first magnetic member and the third and fourth magnetic poles of the second magnetic member each extend over an angular range of 45 degrees or less about the axis of the rotor.

In the rotating display element of the present invention, since the first and second magnetic poles of the first magnetic member and the third and fourth magnetic poles of the second magnetic member, which constitute the stator ( or rotor) of the motor mechanism, each extend over an angular range of only 45 degrees or less about the axis of the rotor, the effective angular ranges of the first to fourth magnetic poles about the axis of the rotor are so narrow that a desired one of the display surfaces of the display surface member can be brought accurately to the front display position rapidly and smoothly.

Further, since the first to fourth magnetic poles of the first and second magnetic members of the stator (or rotor) each extend over an angular range of only 45 degrees or less about the axis of the rotor as mentioned just above, they can be magnetized over their entire angular ranges with far higher intensity, using the same power supply to the first and second exciting windings, than in the case of the afore-mentioned conventional display element in which the first to fourth magnetic poles each extend over as wide an angular range as about 90 degrees about the axis of the rotor. Accordingly, a desired one of the display surfaces can be rapidly brought to the front display position with far less power consumption than would be needed for the conventional display element.

DESCRIPTION OF THE PREFERRED EMBODIMENTS

Figure 1:
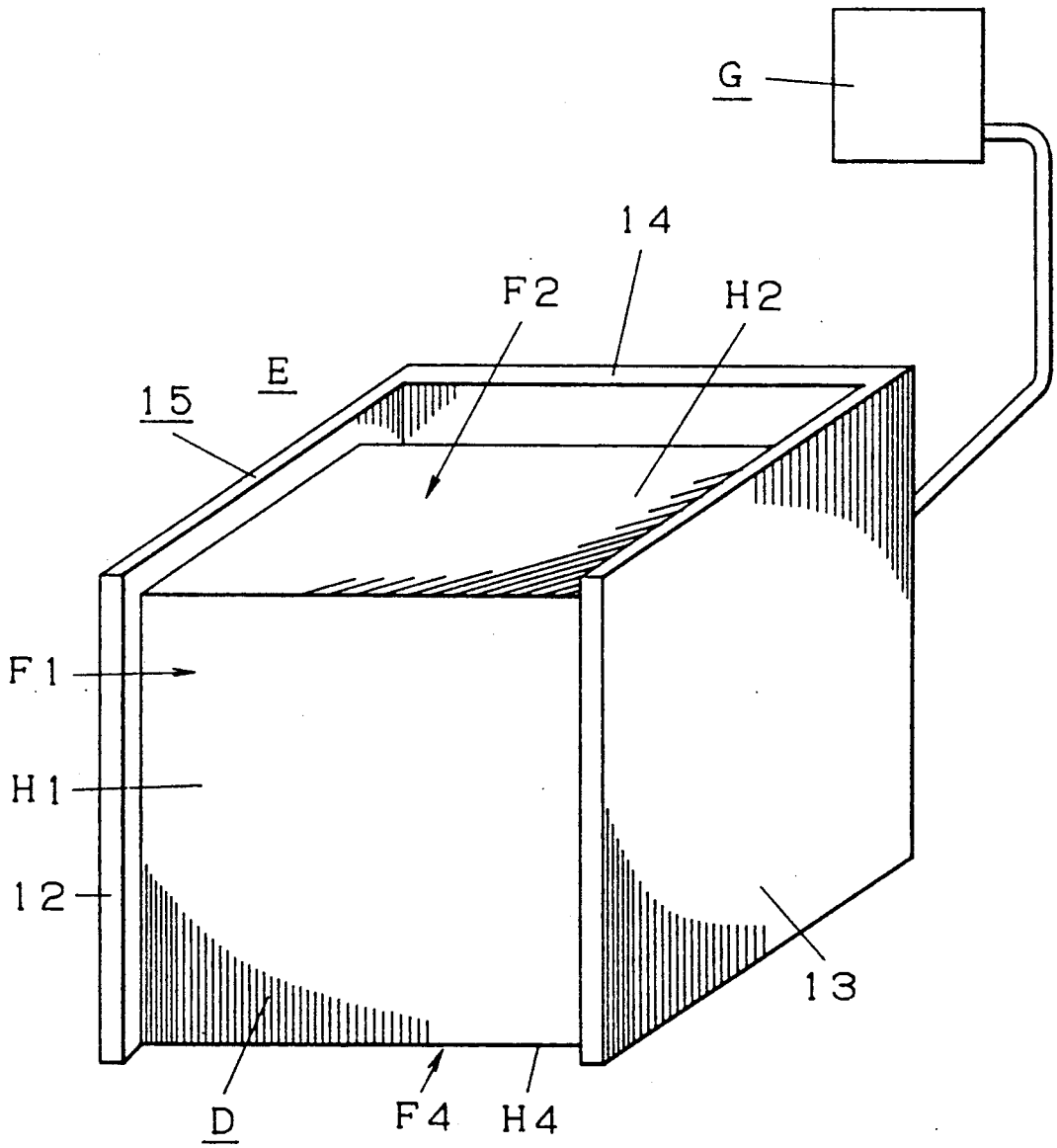
FIG. 1 is a schematic diagram conceptually illustrating an embodiment of the display unit employing the rotating display element according to the present invention.

FIG. 1 conceptually illustrates an embodiment of the display unit employing the rotating display element of the present invention. The display unit is provided with the rotating display element (hereinafter referred to simply as a display element, for the sake of brevity) E and a driving device G for driving it.

The display element E has a display surface member D and a permanent magnet type motor mechanism (hereinafter referred to simply as a motor mechanism, for the sake of brevity) identified by Q in FIGS. 2 to 4.

Figure 2:
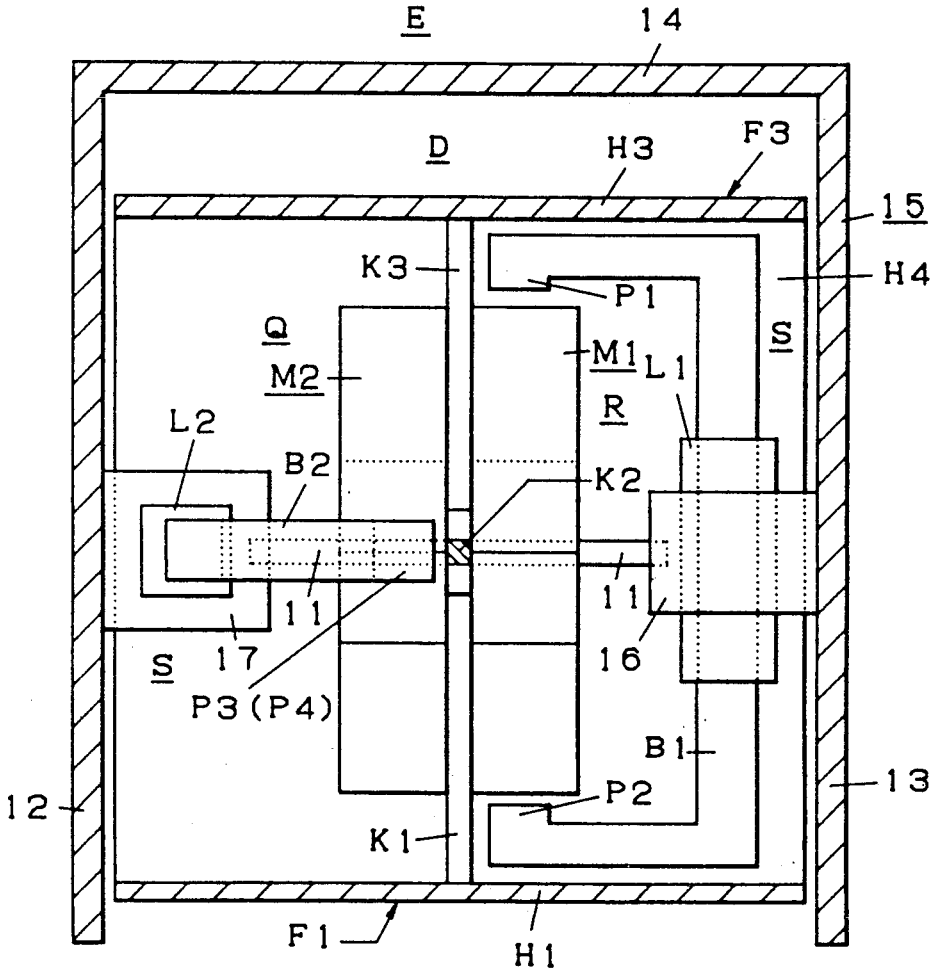
FIG. 2 is a plan view, partly in section, showing an example of the rotating display element used in the display unit depicted in FIG. 1.
Figure 3:
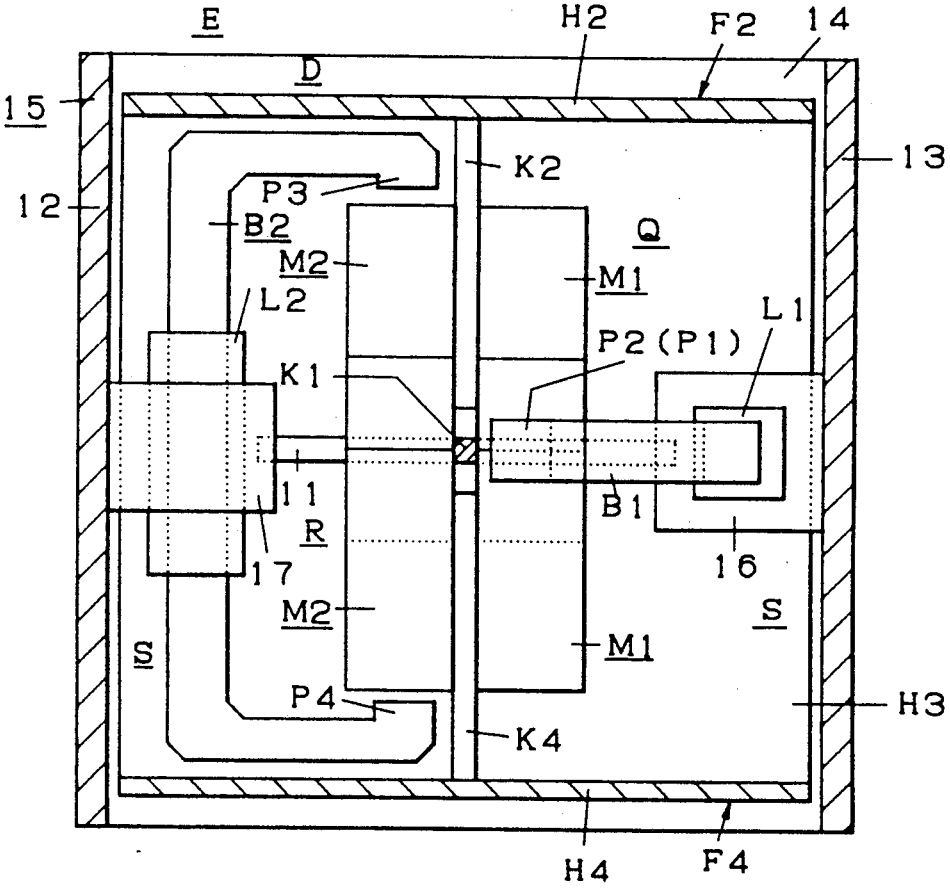
FIG. 3 is a front view, partly in section, of the rotating display element.
Figure 4:
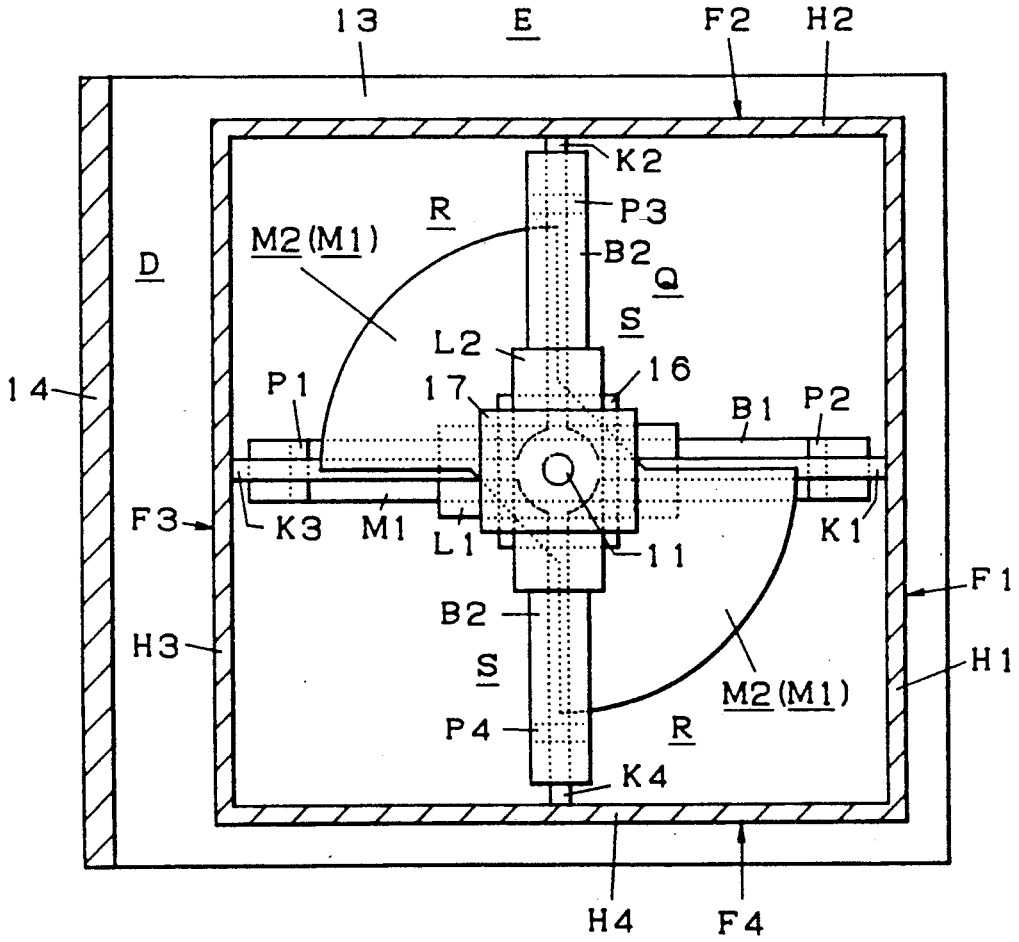
FIG. 4 is a left side view, partly in section, of the rotating display element.

As will be seen from FIGS. 2 to 4, the display surface member D is, for instance, tubular in shape and has four display panels H1, H2, H3 and H4 disposed around its axis at equiangular intervals of 90 degrees. On the outer surfaces of the four display panels H1, H2, H3 and H4 are formed display surfaces F1, F2, F3 and F4, respectively.

An example of the motor mechanism Q has a rotary shaft 11, on which two double-pole permanent magnet members M1 and M2, each magnetized with north and south magnetic poles, are mounted side by side lengthwise thereof.

Figure 5:
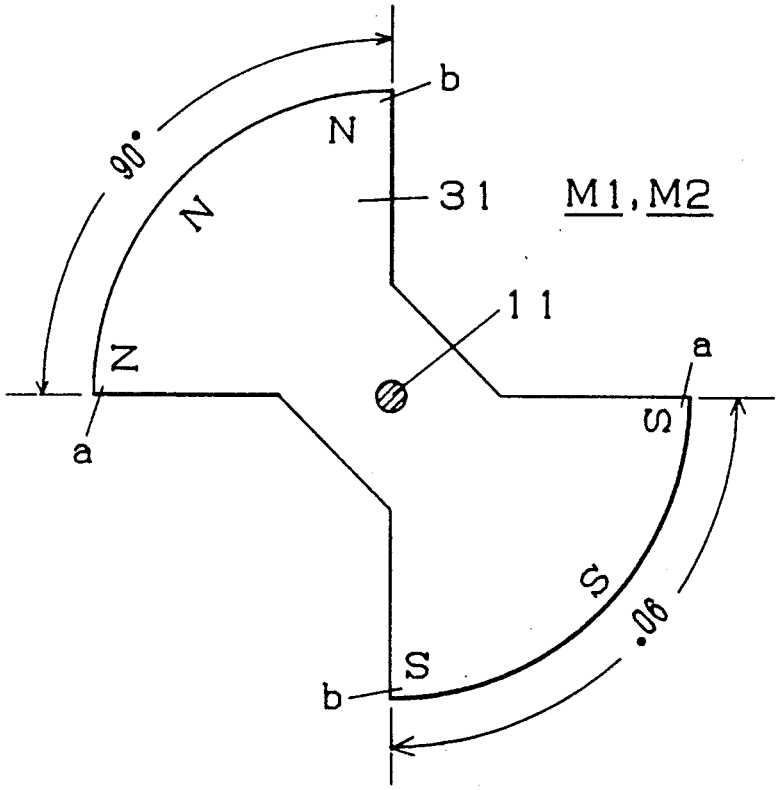
FIG. 5 is a schematic diagram illustrating a double-pole permanent magnet member used in the rotating display element shown in FIGS. 2 through 4.

FIG. 5 shows an example of the double-pole permanent magnet members M1 and M2, which is a magnetic columnar member 31 coaxial with the rotary shaft 11 and having two diametrically opposite sectorial portions spreading out over an angular range of approximately 90 degrees about the rotary shaft 11 and magnetized with the north and south magnetic poles along their peripheral surfaces, respectively.

Figure 6:
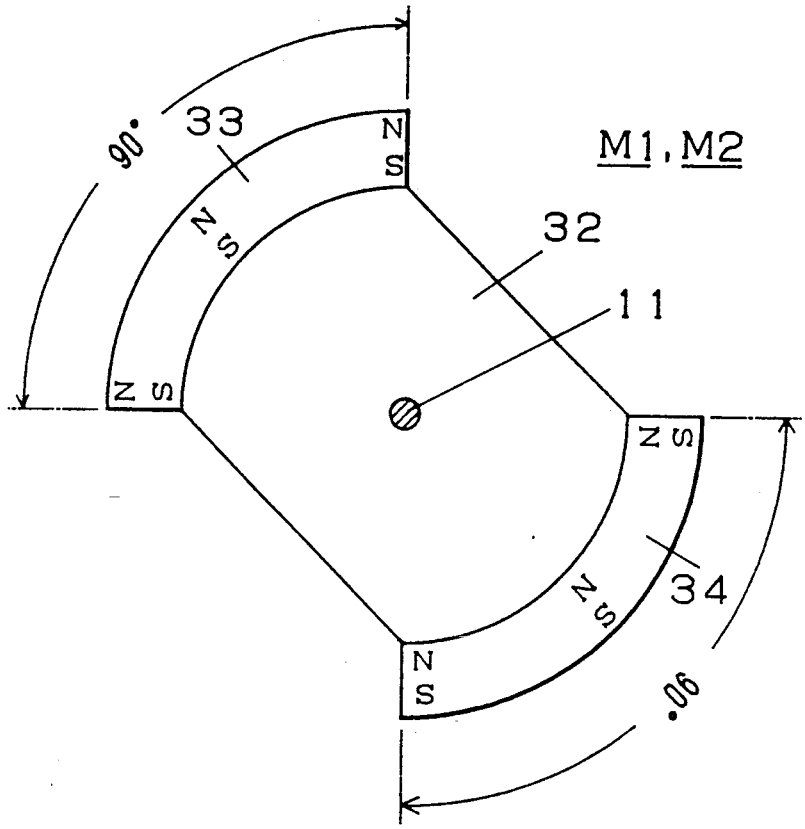
FIGS. 6 and 7 are schematic diagram illustrating other examples of the double-pole permanent magnet member.

FIG. 6 shows another example of the double-pole permanent magnet members M1 and M2, which comprises a non-magnetic columnar member 32 coaxial with the rotary shaft 11 and having two diametrically opposite arc-shaped peripheral surfaces and a pair of arc-shaped pieces 33 and 34 each magnetized with the north and south magnetic poles thickwise thereof and extending over an angular range of approximately 90 degrees about rotary shaft 11. The arc-shaped pieces 33 and 34 are mounted on the non-magnetic columnar member 32 along its diametrically opposite peripheral surfaces, with the north magnetic pole of the piece 33 and the south magnetic pole of piece 34 lying outside their south and north magnetic poles, respectively.

Figure 7:
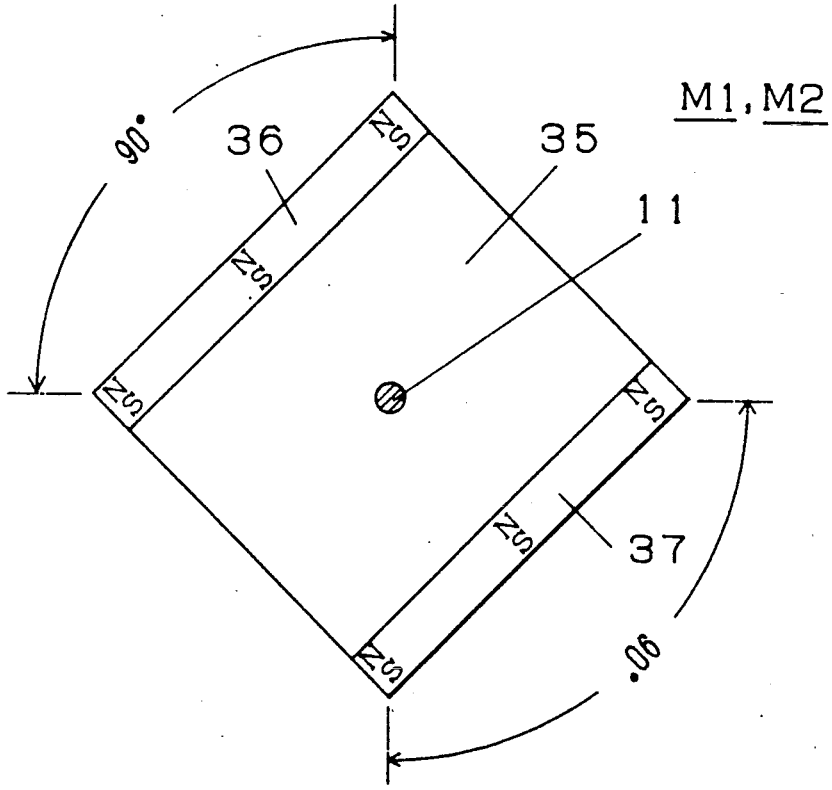

FIG. 7 shows still another example of the double-pole permanent magnet members M1 and M2, which comprises a non-magnetic square columnar member 35 coaxial with the rotary shaft 11 and having two pairs of opposed surfaces symmetrical with respect thereto and a pair of plate-shaped pieces 36 and 37 magnetized with the north and south magnetic poles thickwise thereof. The plate-shaped pieces 36 and 37 are mounted on the non-magnetic member 35 along its two opposed surfaces, with the north magnetic pole of the piece 36 and the south magnetic pole of the piece 37 lying outside their south and north magnetic poles, respectively. In this case, the plate-shaped pieces 36 and 37 each have a length corresponding to about 90 degrees with respect to the axis of the rotary shaft 11.

In FIGS. 2 to 4 the double-pole permanent magnet members M1 and M2 are shown to have the construction described above in respect of FIG. 5.

The north and south poles of the double-pole permanent magnet member M2 are mounted on the rotary shaft 11 at an angular distance $\pm\alpha^\circ$ (where $0 \leqq \alpha^\circ$ 180°) apart from the north and south magnetic poles of the double-pole permanent magnet members M1. In the drawings, there is shown the case where $\alpha^\circ = 0^\circ$, for the sake of simplicity.

The rotary shaft 11 and the double-pole permanent magnet members M1 and M2, mentioned above, constitute a rotor R of the motor mechanism Q.

The rotor R of the motor mechanism Q is journaled in a U-shaped housing 15 which is composed of left-hand, right-hand and rear panels 12, 13 and 14. That is, the rotary shaft 11 of the rotor R is rotatably supported between a support 16 mounted on the right-hand side panel 13 of the housing 15 for a magnetic member B1 and an exciting winding L1 wound thereon as described later and a support 17 mounted on the left-hand side panel 13 of the housing 15 for a magnetic member B2 and an exciting winding L2 wound thereon as described later.

The motor mechanism Q comprises, for example, the magnetic member B1 provided with magnetic poles P1 and P2, which act on the north and south magnetic poles of the double-pole permanent magnet member M1, the magnetic member B2 similarly provided with magnetic poles P3 and P4, which act on the north and south magnetic poles of the double-pole permanent magnet member M2, the exciting winding L1 wound on the magnetic member B1 in a manner to excite the magnetic poles P1 and P2 in reverse polarities, and the exciting winding L2 wound on the magnetic member B2 in a manner to excite the magnetic poles P3 and P4 in reverse polarities.

The magnetic poles P1 and P2 of the magnetic member B1 are spaced apart an angular distance of 180 degrees around the rotary shaft 11 of the rotor R.

The magnetic poles P3 and P4 of the magnetic member B2 are also spaced apart an angular distance of 180 degrees around the rotary shaft 11 of the rotor R, but these magnetic poles P3 and P4 are held at an angular distance $\pm 90^\circ \pm\alpha^\circ$ from the magnetic poles P1 and P2 of the magnetic member B1. In the drawings, there is shown the case where $\alpha^\circ = 0^\circ$ as mentioned previously and $+90^\circ$ is selected from $\pm 90^\circ$, so that the magnetic poles P3 and P4 are shown to be spaced $+90^\circ$ apart from those P1 and P2.

The magnetic poles P1 and P2 of the magnetic member B1 and the magnetic poles P3 and P4 of the magnetic member B2 each extend over a narrow angular range of only 45 degrees or less, preferably 15 degrees or less, around the rotary shaft 11 of the rotor R.

The magnetic members B1 and B2 and the exciting windings L1 and L2 form a stator S of the motor mechanism Q.

The stator S of the motor mechanism Q is fixedly mounted in the afore-mentioned housing 15. That is, the magnetic member B1 and the exciting winding L1 wound thereon are fixed to the housing 15 by the support 16 which grips the exciting winding L1 and is secured to the inner wall of the right-hand side panel 13 of the housing 15. Likewise, the magnetic member B2 and the exciting winding L2 wound thereon are fixed to the housing 15 by the support 17 which grips the exciting winding L2 and is secured to the inner wall of the left-hand side panel 12 of the housing 15.

The display surface member D is mounted on the rotor R of the motor mechanism Q housed therein. That is, four support rods K1, K2, K3 and K4, extending radially of the rotary shaft 11 at equiangular intervals of 90 degrees, are fixed at one end to the rotary shaft 11 centrally thereof between the double-pole permanent magnet members M1 and M2 mounted thereon, the free ends of the support rods K1, K2, K3 and K4 being secured to the display panels H1, H2, H3 and H4 of the display surface member D on the inside thereof, respectively.

In this instance, the display surface member D is mounted on the rotor R in such a manner that the display surfaces F1 to F4 each face to the front, i.e. lies at the front display position when the rotor R assumes one of four predetermined rotational positions as described below with reference to FIGS. 8 to 11. In other words, a one-to-one correspondence exists between the display surfaces F1 to F4 and the four predetermined rotational positions of the rotor R.

Figure 8:
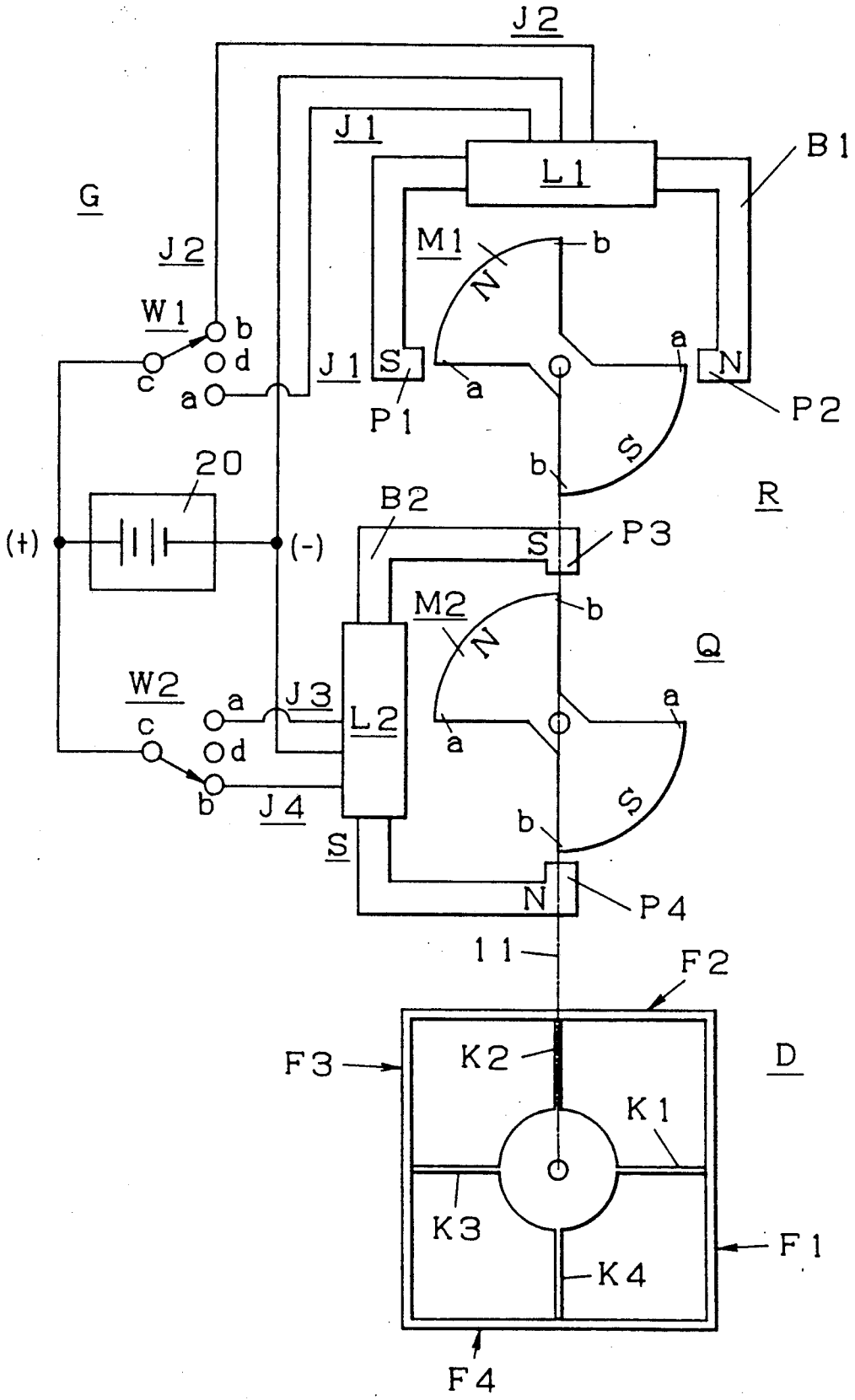
FIGS. 8 through 11 are schematic diagrams for explaining the operation of the display unit of the present invention depicted in FIG. 1.

The display surface F1 of the display surface member D lies at the front display position when the rotor R assumes a rotational position where those edges a of the north and south magnetic poles of the double-pole permanent magnet member M1, which lag behind their other edges b in the clockwise rotation of the rotor R about the rotary shaft 11, are opposed to or aligned with substantially the centers of the magnetic poles P1 and P2 of the magnetic member B1, respectively, and those edges b of the north and south magnetic poles of the double-pole permanent magnet member M2, which lead their other edges a in the clockwise rotation of the rotor R about the rotary shaft 11, are opposed to or aligned with substantially the centers of the magnetic poles P3 and P4 of the magnetic member B2, respectively, as shown in FIG. 8. This rotational position of the rotor R will hereinafter be referred to as the first rotational position.

Figure 9:
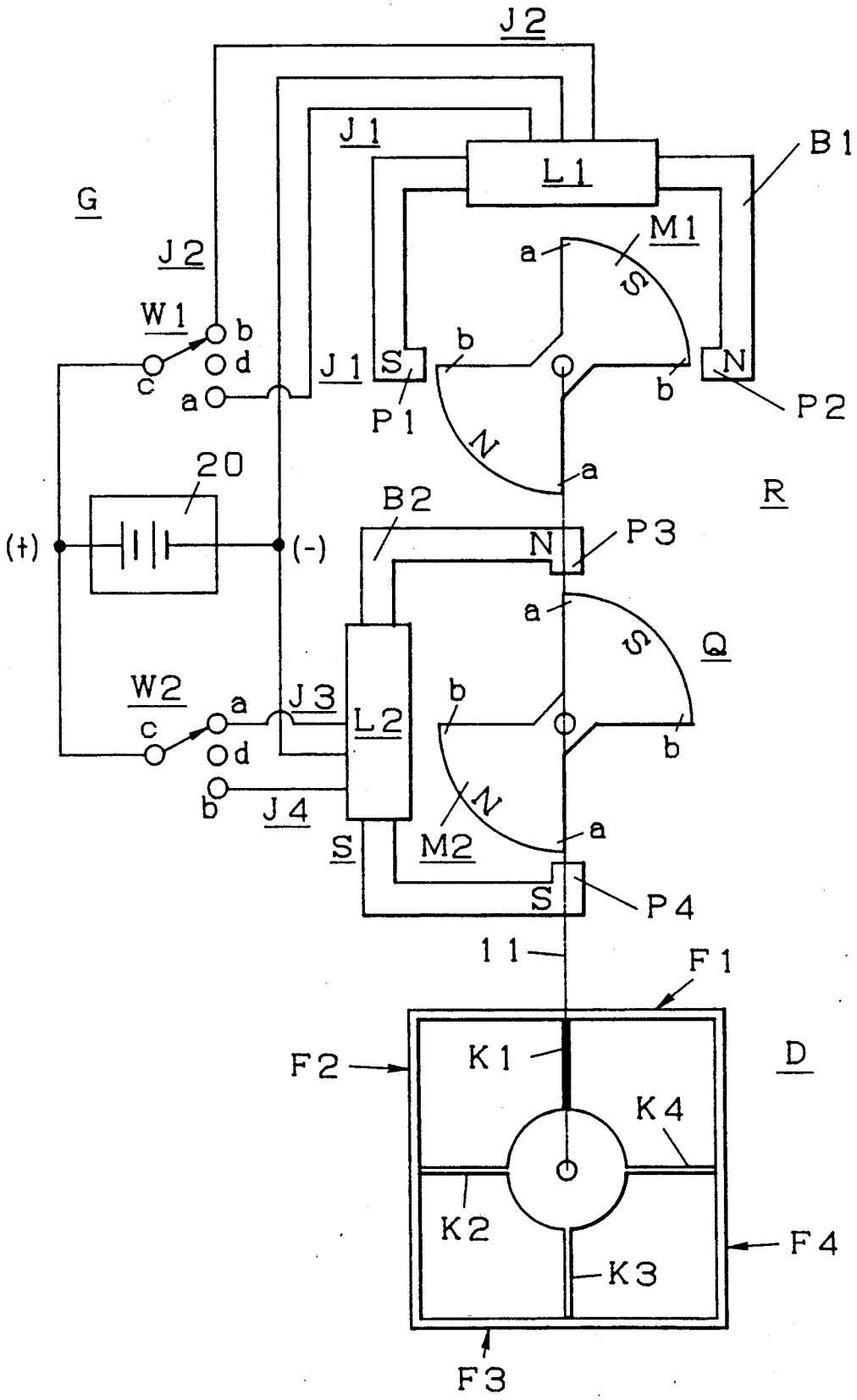

The display surface F4 of the display surface member D lies at the front display position when the rotor R assumes a rotational position where the edges b of the north and south magnetic poles of the double-pole permanent magnet member M1 are opposed to or aligned with substantially the centers of the magnetic poles P1 and P2 of the magnetic member B1, respectively, and the edges a of the north and south magnetic poles of the double-pole permanent magnet member M2 are opposed to or aligned with substantially the centers of the magnetic poles P3 and P4 of the magnetic member B2, respectively, as shown in FIG. 9. This rotational position of the rotor R will hereinafter be referred to as the fourth rotational position.

Figure 10:
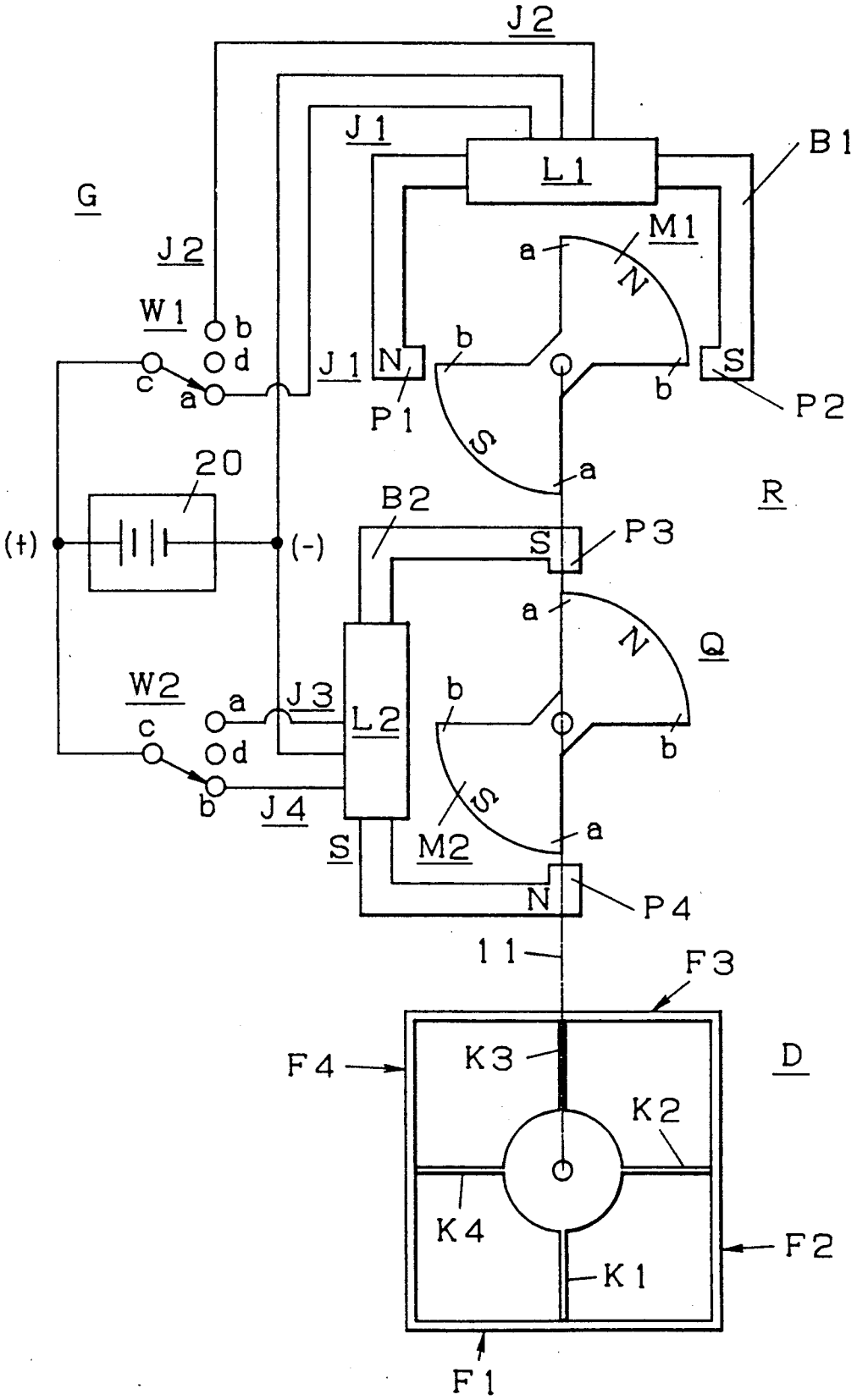

The display surface F2 of the display surface member D lies at the front display position when the rotor R assumes a rotational position where the edges b of the north and south magnetic poles of the double-pole permanent magnet member M1 are opposed to or aligned with substantially the centers of the magnetic poles P1 and P2 of the magnetic member B1, respectively, and those edges a of the north and south magnetic poles of the double-pole permanent magnet member M2 are opposed to or aligned with substantially the centers of the magnetic poles P3 and P4 of the magnetic member B2, respectively, as shown in FIG. 10. This rotational position of the rotor R will hereinafter be referred to as the second rotational position.

Figure 11:
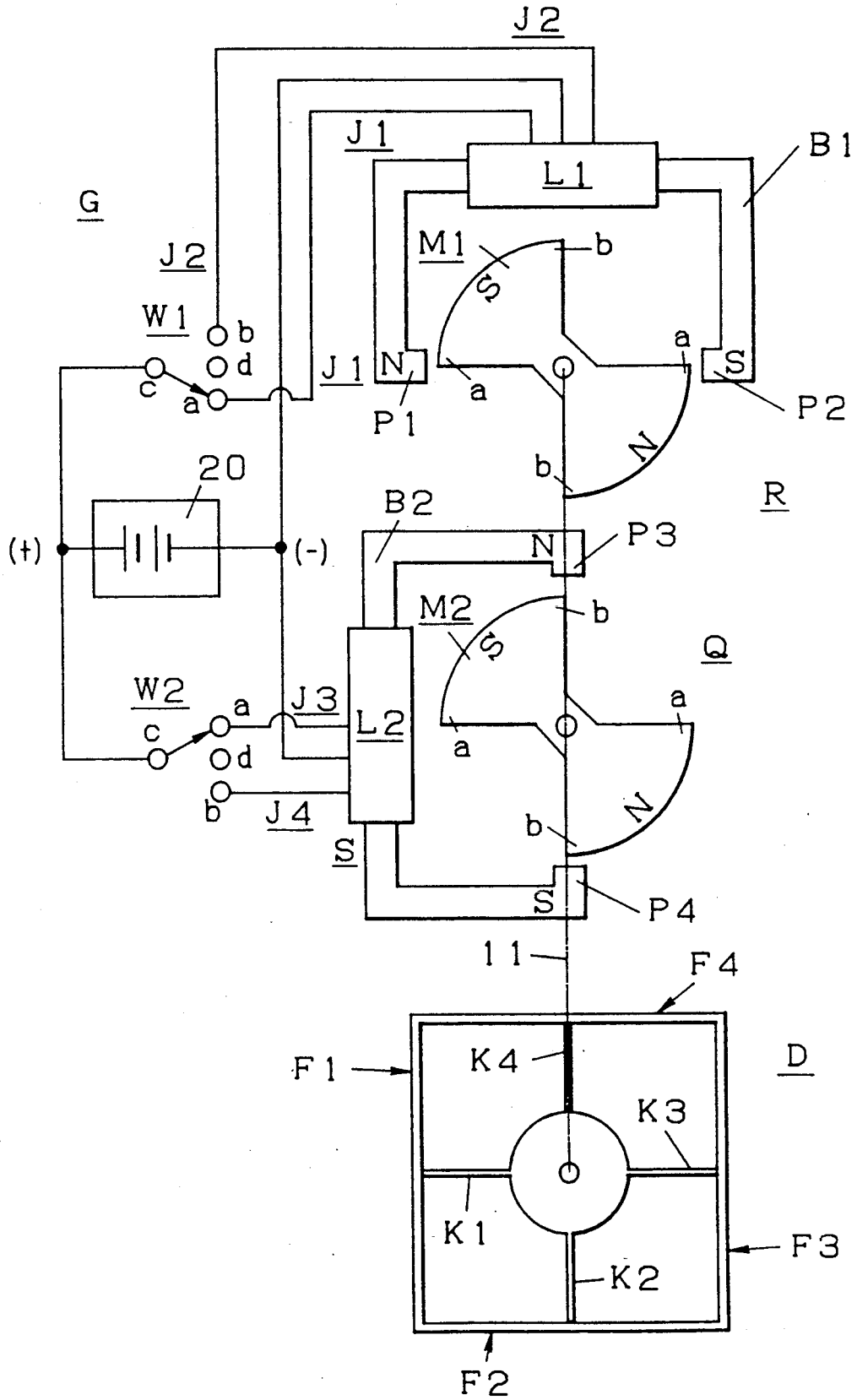

The display surface F3 of the display surface member D lies at the front display position when the rotor R assumes a rotational position where the edges a of the north and south magnetic poles of the double-pole permanent magnet member M1 are opposed to or aligned with substantially the centers of the magnetic poles P1 and P2 of the magnetic member B1, respectively, and those edges b of the north and south magnetic poles of the double-pole permanent magnet member M2 are opposed to or aligned with substantially the centers of the magnetic poles P4 and P3 of the magnetic member B2, respectively, as shown in FIG. 11. This rotational position of the rotor R will hereinafter be referred to as the third rotational position.

As illustrated in FIGS. 8 to 11, the driving device G is provided with power supply means J1 for supplying power to the exciting winding L1 of the stator S of the motor mechanism Q to make the magnetic poles P1 and P2 of the magnetic member B1 serve as north and south magnetic poles, respectively, power supply means J2 for supplying power to the exciting winding L1 to make the magnetic poles P1 and P2 of the magnetic member B1 serve as south and north magnetic poles, respectively, power supply means J3 for supplying power to the exciting winding L2 of the stator S of the motor mechanism Q to make the magnetic poles P3 and P4 of the magnetic member B2 act as north and south magnetic poles, respectively, and power supply means J4 for supplying power to the exciting winding L2 to make the magnetic poles P3 and P4 of the magnetic member B2 act as south and north magnetic poles, respectively.

The power supply means J1 has, for example, an arrangement in which the positive side of a DC power source 20 is connected to one end of the exciting winding L1 via a movable contact and a fixed contact a of a change-over switch W1 and the negative side of the DC power source 20 is connected directly to the mid point of the exciting winding L1.

The power supply means J2 has, for example, an arrangement in which the positive side of the DC power source 20 is connected to the other end of the exciting winding L1 via the movable contact a and another fixed contact b of the change-over switch W1 and the negative side of the DC power source 20 is connected directly to the mid point of the exciting winding L1.

The power supply means J3 has, for example, an arrangement in which the positive side of the DC power source 20 is connected to one end of the exciting winding L2 via a movable contact c and a fixed contact a of a change-over switch W2 and the negative side of the DC power source 20 is connected directly to the mid point of the exciting winding L2.

The power supply means J4 has, for example, an arrangement in which the positive side of the DC power source 20 is connected to the other end of the exciting winding L2 via the movable contact c and another contact b of the change-over switch W2 and the negative side of the DC power source 20 is connected directly to the mid point of the exciting winding L2.

Next, a detailed description will be given of the arrangement and the operation of the display unit.

With the above-described arrangement of the display unit employing the rotating display element E according to the present invention, the rotor R of the motor mechanism Q has the two double-pole permanent magnet members M1 and M2 mounted on the rotary shaft 11. The north and south magnetic poles of the double-pole permanent magnet member M1 and the north and south magnetic poles of the double-pole permanent magnet member M2 are spaced an angular distance of $\pm\alpha^\circ$ (where $\alpha^\circ=0^\circ$, in this example) apart around the rotary shaft 11, respectively.

On the other hand, the stator S of the motor mechanism Q has the magnetic member B1 provided with the magnetic poles P1 and P2 which are spaced an angular distance of 180 degrees apart around the rotary shaft 11 and act on the north and south magnetic poles of the double-pole permanent magnet member M1 and the magnetic member B2 provided with the magnetic poles P3 and P4 which are spaced an angular distance of $\pm 90^\circ \pm \alpha^\circ$ ($+90^\circ$ in this example) apart from the magnetic poles P1 and P2 of the double-pole permanent magnet member M1 and disposed at 180 degrees intervals around the rotary shaft 11 and act on the north and south magnetic poles of the double-pole permanent magnet member M2. The magnetic poles P1 and P2 of the magnetic member B1 extend over an angular range of only 45 degrees or less around the rotary shaft 11, and the magnetic poles P3 and P4 of the magnetic member B2 similarly extend over an angular rang of only 45 degrees or less around the rotary shaft 11.

With such an arrangement, when the movable contacts a of the afore-said change-over switches W1 and W2 are connected to fixed contacts d that is, when no power is supplied to either of the exciting windings L1 and L2 of the stator S, the rotor R of the motor mechanism Q assumes the first rotational position described previously with regard to FIG. 8, the fourth rotational position described previously with regard to FIG. 9, the second rotational position described previously with regard to FIG. 10, or the third rotational position described previously with regard to FIG. 11.

The reason for this is as follows:

In the case where the rotor R tends to rotate counterclockwise from its first rotational position shown in FIG. 8, since the north and south magnetic poles of the double-pole permanent magnet member M1 stay opposite the magnetic poles P1 and P2 of the magnetic member B1, there does not develop in the double-pole permanent magnet member M1 a torque which prevents the rotor R from rotating counterclockwise. However, since the north and south magnetic poles of the double-pole permanent magnet member M2 move out of the opposing relation to the magnetic poles P3 and P4 of the magnetic member B2, there develops in the double-pole permanent magnet member M2 a torque which prevents the rotor R from rotating counterclockwise. Further, in the case where the rotor R tends to rotate clockwise from its first rotational position shown in FIG. 8, since the north and south magnetic poles of the double-pole permanent magnet member M2 stay opposite the magnetic poles P3 and P4 of the magnetic member B2, there does not develop in the double-pole permanent magnet member M2 a torque which prevents the rotor R from rotating clockwise. However, since the north and south magnetic poles of the double-pole permanent magnet member M1 leave the magnetic poles P1 and P2 of the magnetic member B1, there develops in the double-pole permanent magnet M1 a torque which prevents the rotor R from rotating clockwise.

In the case where the rotor R tends to rotate clockwise from its fourth rotational position shown in FIG. 9, since the north and south magnetic poles of the double-pole permanent magnet member M1 stay opposite the magnetic poles P1 and P2 of the magnetic member B1, there does not develop in the double-pole permanent magnet member M1 a torque which prevents the rotor R from rotating clockwise. However, since the north and south magnetic poles of the double-pole permanent magnet member M2 leave the magnetic poles P4 and P3 of the magnetic member B2, there develops in the double-pole permanent magnet member M2 a torque which prevents the rotor R from rotating clockwise. Further, in the case where the rotor R tends to rotate counterclockwise from its fourth rotational position shown in FIG. 9, since the north and south magnetic poles of the double-pole permanent magnet member M2 stay opposite the magnetic poles P4 and P3 of the magnetic member B2, there does not develop in the double-pole permanent magnet member M2 a torque which prevents the rotor R from rotating counterclockwise. However, since the north and south magnetic poles of the double-pole permanent magnet member M1 leave the magnetic poles P1 and P2 of the magnetic member B1, there develops in the double-pole permanent magnet member M1 a torque which prevents the rotor R from rotating counterclockwise.

In the case where the rotor R tends to rotate clockwise from its second rotational position shown in FIG. 10, since the north and south magnetic poles of the double-pole permanent magnet member M1 stay opposite the magnetic poles P2 and P1 of the magnetic member B1, there does not develop in the double-pole permanent magnet member M1 a torque which prevents the rotor R from rotating clockwise. However since the north and south magnetic poles of the double-pole permanent magnet member M2 leave the magnetic poles P3 and P4 of the magnetic member B2, there develops in the double-pole permanent magnet member M2 a torque which prevents the rotor R from rotating clockwise. Further, in the case where the rotor R tends to rotate counterclockwise from its second rotational position shown in FIG. 10, since the north and south magnetic poles of the double-pole permanent magnet member M2 stay opposite the magnetic poles P3 and P4 of the magnetic member B2, there does not develop in the double-pole permanent magnet member M2 a torque which prevents the rotor R from rotating counterclockwise. However since the north and south magnetic poles of the double-pole permanent magnet member M1 leave the magnetic poles P2 and P1 of the magnetic member B1, there develops in the double-pole permanent magnet M1 a torque which prevents the rotor R from rotating counterclockwise.

In the case where the rotor R tends to rotate counterclockwise from its third rotational position shown in FIG. 11, since the north and south magnetic poles of the double-pole permanent magnet member M1 stay opposite the magnetic poles P2 and P1 of the magnetic member B1, there does not develop in the double-pole permanent magnet member M1 a torque which prevents the rotor R from rotating counterclockwise. However, since the north and south magnetic poles of the double-pole permanent magnet member M2 leave the magnetic poles P4 and P3 of the magnetic member B2, there develops in the double-pole permanent magnet member M2 a torque which prevents the rotor R from rotating counterclockwise. Further, in a case where the rotor R tends to rotate clockwise from its third rotational position shown in FIG. 11, since the north and south magnetic poles of the double-pole permanent magnet member M2 stay opposite the magnetic poles P4 and P3 of the magnetic member B2, there does not develop in the double-pole permanent magnet member M2 a torque which prevents the rotor R from rotating clockwise. However, since the north and south magnetic poles of the double-pole permanent magnet member M1 leave the magnetic poles P2 and P1 of the magnetic member B1, there develops in the double-pole permanent magnet M1 a torque which prevents the rotor R from rotating clockwise.

For the reasons given above, when no power is supplied to either of the exciting windings L1 and L2 of the stator S, the rotor R assumes any one of the first, second, third and fourth rotational positions.

Furthermore, the display surface member D is mounted on the rotor R of the motor mechanism Q so that the display surfaces F1, F2, F3 and F4 respectively face to the front when the rotor R assumes the first, second, third and fourth rotational positions as described previously.

Now, let it be assumed that the rotor R of the motor mechanism Q lies at the first rotational position, and consequently, the display element E is in a state in which the display surface F1 of the display surface member D faces to the front (This state will hereinafter be referred to as the first state). In such a first state of the display element E, even if power is supplied via the power supply means J2 to the exciting winding L1 of the stator S of the motor mechanism Q and to the exciting winding L2 via the power supply means J4 for a very short time at about the same time, as shown in FIG. 8, the display element E will remain in the first state.

The reason for this is as follows:

By the power supply to the exciting winding L1 via the power supply means J2, the magnetic poles P1 and P2 of the magnetic member B1 are magnetized with south and north magnetic poles to produce a small counterclockwise torque in the double-pole permanent magnet member M1, urging the rotor R to turn counterclockwise. By the power supply to the exciting winding L2 via the power supply means J4, however, the magnetic poles P3 and P4 of the magnetic member B2 are magnetized with south and north magnetic poles to produce a small clockwise torque in the double-pole permanent magnet member M2, urging the rotor R to turn clockwise. Accordingly, there develops in the rotor R no torque or only a small counterclockwise or clockwise rotating torque. In the case where the small counterclockwise torque is yielded in the rotor R, the north and south magnetic poles of the double-pole permanent magnet member M1 remain opposite the magnetic poles P1 and P2 of the magnetic member B1 now magnetized as the south and north magnetic poles; so that there does not develop in the double-pole permanent magnet member M1 a torque which prevents the rotor R from rotating counterclockwise. However, since the north and south magnetic poles of the double-pole permanent magnet member M2 leave the magnetic poles P3 and P4 of the magnetic member B2 now magnetized as the south and north magnetic poles, there is produced in the double-pole permanent magnet member M2 a torque which prevents counterclockwise rotational movement of the rotor R. Further, in the case where the above-said small clockwise torque is produced in the rotor R, the north and south magnetic poles of the double-pole permanent magnet member M2 stay opposite the magnetic poles P3 and P4 of the magnetic member B2 magnetized as the south and north magnetic poles; so that there does not develop in the double-pole permanent magnet member M2 a torque which prevents the rotor R from rotating clockwise. However, since the north and south magnetic poles of the double-pole permanent magnet member M1 leave the magnetic poles P1 and P2 acting as the south and north magnetic poles, there is produced in the double-pole permanent magnet member M1 a torque which prevents the clockwise rotational movement of the rotor R.

Thus, the display element E remains in the first state, even if power is supplied to the exciting windings L1 and L2 via the power supply means J2 and J4 when the display element E is in the first state.

When the display element E is in the first state, if power is supplied via the power supply means J2 to the exciting winding L1 and to the exciting winding L2 via the power supply means J3 for a very short time at about the same time, as shown in FIG. 9, the rotor R of the motor mechanism Q will assume the afore-mentioned fourth rotational position. Consequently, the display element E is switched to and held in the state in which its display surface F4 stays at the front display position (which state will hereinafter be referred to as the fourth state).

The reason for this is as follows:

By the power supply to the exciting winding L1 via the power supply means J2, the magnetic poles P1 and P2 of the magnetic member B1 are magnetized with the south and north magnetic poles. In this case, however, since the afore-mentioned edges a of the north and south magnetic poles of the double-pole permanent magnet member M1 stay opposite the north and south magnetic poles P1 and P2 substantially at their centers, respectively, no torque is produced in the double-pole permanent magnet member M1, or even if produced, it is only a small counterclockwise torque. By the power supply to the exciting winding L2 via the power supply means J3, however, the magnetic poles P3 and P4 of the magnetic member B2 are magnetized with the north and south magnetic poles. In this case, since the afore-mentioned edges b of the north and south magnetic poles of the double-pole permanent magnet member M2 stay opposite the north and magnetic poles P3 and P4 substantially at their centers, respectively, a large counterclockwise torque is produced in the double-pole permanent magnet M2 owing to repulsion between its north magnetic pole and the north-magnetized pole P3 and between its south magnetic pole and the south-magnetized pole P4. In consequence, a counterclockwise torque is produced in the rotor R, turning it counterclockwise.

When the rotor R thus turns counterclockwise and if it further rotates in excess of 45 degrees from the first rotational position, the north and south magnetic poles of the double-pole permanent magnet M1 remain in the opposing relation to the magnetic poles P1 and P2 of the magnetic member B1 now magnetized with the south and north magnetic poles, and consequently, no torque is produced in the double-pole permanent magnet M1, or even if generated, it is only a small clockwise torque. However, since the north and south magnetic poles of the double-pole permanent magnet M2 approach the magnetic poles P4 and P3 now magnetized with the south and north magnetic poles, a large counterclockwise torque is generated in the double-pole permanent magnet M2 by virtue of attraction between its north magnetic pole and the south-magnetized pole P4 and between its south magnetic pole and the north-magnetized pole P3. As a result of this, the rotor R turns counterclockwise.

When the rotor R thus turns counterclockwise and if it further rotates in excess of 90 degrees from the first rotational position, the edges a of the north and south magnetic poles of the double-pole permanent magnet M2 turn into opposing relation to the magnetic poles P4 and P3 of the magnetic member B2 now magnetized with the south and north magnetic poles; so that no torque is developed in the double-pole permanent magnet M2, or even if produced, it is only a small counterclockwise torque. However, since the north and south magnetic poles of the double-pole permanent magnet M1 are out of opposing relation to the magnetic poles P1 and P2 now magnetized with the south and north magnetic poles, there is produced in the double-pole permanent magnet M1 a large torque which prevents the rotor R from rotating counterclockwise in excess of 90 degrees from the first state. Consequently, the rotor R does not turn counterclockwise in excess of 90 degrees from the first rotational position.

For the reason given above, supplying power to the exciting windings L1 and L2 via the power supply means J2 and J3 when the display element E assumes the first state, the display element E is switched to and held in the fourth state.

When the display element E is in the first state, if power is supplied via the power supply means J1 to the exciting winding L1 and to the exciting winding L2 via the power supply means J4 for a very short time at about the same time, as shown in FIG. 10, the rotor R of the motor mechanism Q will assume the second rotational position, where the display element E is switched to and held in the state in which its display surface F2 faces to the front (which state will hereinafter be referred to as the second state).

The reason for this is as follows:

By the power supply to the exciting winding L2 via the power supply means J4, the magnetic poles P3 and P4 of the magnetic member B2 are magnetized with the south and north magnetic poles. In this case, however, since the edges b of the north and south magnetic poles of the double-pole permanent magnet member M2 are opposite the magnetic poles P3 and P4 substantially at their centers no torque is produced in the double-pole permanent magnet member M2 and, even if produced, it is only a small clockwise torque. By the power supply to the exciting winding L1 via the power supply means J1, however, the magnetic poles P1 and P2 of the magnetic member B1 are magnetized with the north and south magnetic poles. In this case, since the edges a of the north and south magnetic poles of the double-pole permanent M1 lie opposite the magnetic poles P1 and P2 substantially at their centers, a large clockwise torque is produced in the double-pole permanent magnet M1 owing to repulsion between its north magnetic pole and the north-magnetized pole P1 and between its south magnetic pole and the south-magnetized pole P2. In consequence, a large clockwise torque is produced in the rotor R, turning it clockwise.

When the rotor R thus turns clockwise and if it further rotates in excess of 45 degrees from the first rotational position, the north and south magnetic poles of the double-pole permanent magnet M2 remain in the opposing relation to the magnetic poles P3 and P4 of the magnetic member B2 now magnetized with the south and north magnetic poles; so that no torque is produced in the double-pole permanent magnet M2, or even if generated, it is only a small counterclockwise torque. However, since the north and south magnetic poles of the double-pole permanent magnet M1 approach the magnetic poles P2 and P1 now magnetized with the south and north magnetic poles, a large clockwise torque is generated in the double-pole permanent magnet M1 by virtue of attraction between its north magnetic pole and the south-magnetized pole P2 and between its south magnetic pole and the north-magnetized pole P1. As a result of this, the rotor R turns clockwise.

When the rotor R thus turns clockwise and if it further rotates in excess of 90 degrees from the first state, the edges b of the north and south magnetic poles of the double-pole permanent magnet M1 turn into opposing relation to the magnetic poles P2 and P1 of the magnetic member B1 now magnetized with the south and north magnetic poles, so that no torque is developed in the double-pole permanent magnet M1, or even if produced, it is only a small clockwise torque. However, since the north and south magnetic poles of the double-pole permanent magnet M2 get out of opposing relation to the magnetic poles P3 and P4 now magnetized with the south and north magnetic poles, there is produced in the double-pole permanent magnet M2 a large torque which prevents the rotor R from rotating clockwise in excess of 90 degrees from the first state. Consequently, the rotor R does not turn clockwise in excess of 90 degrees from the first rotational position.

For the reason given above, supplying power to the exciting windings L1 and L2 via the power supply means J1 and J4 when the display element E assumes the first state, the display element E is switched to and held in the second state.

When the display element E is in the first state, if power is supplied via the power supply means J1 to the exciting winding L1 and to the exciting winding L2 via the power supply means J3 for a very short time as shown in FIG. 11, the rotor R of the motor mechanism Q will assume the third rotational position, where the display element E is switched to and held in the state in which its display surface F3 faces to the front (which state will hereinafter be referred to as the third state).

The reason for this is as follows:

Let it be assumed that power is supplied first to the exciting winding L1 via the power supply means J1 and then to the exciting winding L2 via the power supply means J3 a little after the start of the power supply to the former.

In such a case, the power supply to the exciting winding L1 via the power supply means J1 magnetized the magnetic poles P1 and P2 of the magnetic member B1 with the north and south magnetic poles. In this case, since the edges a of the north and magnetic poles of the double-pole permanent magnet M1 lie opposite the magnetic poles P1 and P2, a large clockwise torque is produced in the double-pole permanent magnet M1 owing to repulsion between its north magnetic pole and the north-magnetized pole P1 and between its south magnetic pole and the south-magnetized pole P2. In consequence, a clockwise torque is produced in the rotor R, turning it clockwise.

When the rotor R thus turns clockwise and if it further rotates in excess of 45 degrees from the first state, the north and south magnetic poles of the double-pole permanent magnet M1 approach the magnetic poles P2 and P1 now magnetized with the south and north magnetic poles. Hence, a large clockwise torque is generated in the double-pole permanent magnet M1 by virtue of attraction between its north magnetic pole and the south-magnetized pole P2 and between its south magnetic pole and the north-magnetized pole P1.

Further, if the power supply to the exciting winding L2 via the power supply means J3 is effected at or in the vicinity of the point of time when the rotor R has just turned clockwise more than 45 degrees from the first rotational position, then the magnetic poles P3 and P4 of the magnetic member B2 will be magnetized with the north and south magnetic poles at that point of time. In this instance, since the north and south magnetic poles of the double-pole permanent magnet M2 lie opposite the magnetic poles P3 and P4, a clockwise torque is generated in the double-pole permanent magnet M2 by virtue of repulsion between its north magnetic pole and the north-magnetized pole P3 and between its south magnetic pole and the south magnetized pole P4. As a result of this, the rotor R turns clockwise.

When the rotor R thus turns clockwise and if it further rotates in excess of 90 degrees from the first state, the edges b of the north and south magnetic poles of the double-pole permanent magnet M1 turn into opposing relation to the magnetic poles P2 and P1 of the magnetic member B1 now magnetized with the south and north magnetic poles, so that no torque is developed in the double-pole permanent magnet M1, or even if produced, it is only a small clockwise torque. However, since the edges a of the north and south magnetic poles of the double-pole permanent magnet M2 are opposite the magnetic poles P3 and P4 now magnetized with the north and south magnetic poles, there is produced in the double-pole permanent magnet M2 a large clockwise torque owing to repulsion between its north magnetic pole and the north-magnetized pole P3 and between its south magnetic pole and the south-magnetized pole P4. In consequence, a clockwise torque is produced in the rotor R, turning it clockwise.

When the rotor R thus turns clockwise and if it further rotates in excess of 135 degrees from the first rotational position, the north and south magnetic poles of the double-pole permanent magnet M1 remain in the opposing relation to the magnetic poles P2 and P1 of the magnetic member B1 now magnetized with the south and north magnetic poles, so that no torque is produced in the double-pole permanent magnet M1, or even if generated, it is only a small counterclockwise torque. However, since the north and south magnetic poles of the double-pole permanent magnet M2 approach the magnetic poles P4 and P3 now magnetized with the south and north magnetic poles, respectively, a large clockwise torque is generated in the double-pole permanent magnet M2 by virtue of attraction between its north magnetic pole and the south-magnetized pole P4 and between its south magnetic pole and the north-magnetized pole P3. As a result of this, the rotor R turns clockwise.

When the rotor R thus turns clockwise if it further rotates in excess of 180 degrees from the first rotational position, the north and south magnetic poles of the double-pole permanent magnet M2 turn into opposing relation to the magnetic poles P4 and P3 of the magnetic member B2 now magnetized with the south and north magnetic poles, so that no torque is developed in the double-pole permanent magnet M2, or even if produced, it is only a small clockwise torque. However, since the north and south magnetic poles of the double-pole permanent magnet M1 are out of opposing relation to the magnetic poles P2 and P1 now magnetized with the south and north magnetic poles, there is produced in the double-pole permanent magnet M1 a large torque which prevents the rotor R from rotating clockwise in excess of 180 degrees from the first state. Therefore, the rotor R does not turn clockwise in excess of 180 degrees from the first rotational position.

The above description has been given of the case where the power supply to the exciting winding L1 via the power supply means J1 takes place a little earlier than the power supply to the exciting winding L2 via the power supply means J3, but in the opposite case, the rotor R turns by 180 degrees from the first rotational position in the counterclockwise direction reverse from that in the above, though not described in detail.

For the reason given above, when supplying power to the exciting windings L1 and L2 via the power supply means J1 and J3 in the state in which the display element E assumes the first state, the display element E is switched to and held in the third state.

Now, let it be assumed that the rotor R of the motor mechanism Q lies at the fourth rotational position, with the display element E in the fourth state in which the display surface F4 of the display surface member D faces to the front. In such a fourth state of the display element E, even if power is supplied via the power supply means J2 to the exciting winding L1 of stator S of the motor mechanism Q and to the exciting winding L2 via the power supply means J3 for a very short time at about the same time, as shown in FIG. 9, the display element E will remain in the fourth state.

The reason for this is as follows:

By the power supply to the exciting winding L1 via the power supply means J2, the magnetic poles P1 and P2 of the magnetic member B1 are magnetized with south and north magnetic poles to produce a small clockwise torque in the double-pole permanent magnet member M1, urging the rotor R to rotate clockwise. By the power supply to the exciting winding L2 via the power supply means J3, however, the magnetic poles P3 and P4 of the magnetic member B2 are magnetized with north and south magnetic poles to produce a small counterclockwise torque in the double-pole permanent magnet member M2, urging the rotor R to rotate counterclockwise. Accordingly, there develops in the rotor R no torque, or only a small clockwise or counterclockwise torque. In the case where the small clockwise torque is produced in the rotor R, the north and south magnetic poles of the double-pole permanent magnet member M1 remain in the opposing relation to the magnetic poles P1 and P2 of the magnetic member B1 now magnetized as the south and north magnetic poles; so that there does not develop in the double-pole permanent magnet member M1 a torque which prevents the rotor R from rotating clockwise. However, since the north and south magnetic poles of the double-pole permanent magnet member M2 turn out of the opposing relation to the magnetic poles P4 and P3 of the magnetic member B2 now magnetized as the south and north magnetic poles, there is produced in the double-pole permanent magnet member M2 a torque which prevents clockwise rotational movement of the rotor R. Further, in the case where the above-said small counterclockwise torque is produced in the rotor R, the north and south magnetic poles of the double-pole permanent magnet member M2 do not turn out of the opposing relation to the magnetic poles P4 and P3 magnetized as the south and north magnetic poles, so that there does not develop in the double-pole permanent magnet member M2 a torque which prevents the rotor R from rotating counterclockwise. In this instance, however, since the north an south magnetic poles of the double-pole permanent magnet member M1 get out of the opposing relation to the magnetic poles P1 and P2 magnetized as the south and north magnetic poles, there is created in the double-pole permanent magnet member M1 a torque which prevents the counter-clockwise rotational movement of the rotor R.

For the reason given above, the display element E will remain in the fourth state, even if power is supplied to the exciting windings L1 and L2 via the power supply means J2 and J3 when the display element E is in the fourth state.

When the display element E is in the fourth state, if power is supplied via the power supply means J2 to the exciting winding L1 and to the exciting winding L2 via the power supply means J4 for a very short time at about the same time, as shown in FIG. 8, the rotor R of the motor mechanism Q will assume the afore-mentioned first rotational position, where the display element E is switched to and retained in the first state in which its display surface F1 faces front.

The reason for this is as follows:

By the power supply to the exciting winding L1 via the power supply means J2, the magnetic poles P1 and P2 of the magnetic member B1 are magnetized with the south and north magnetic poles. In this case, since the edges b of the north and south magnetic poles of the double-pole permanent magnet member M1 are opposite the magnetic poles P1 and P2, no torque is produced in the double-pole permanent magnet member M1 and, even if produced, it is only a small clockwise torque. By the power supply to the exciting winding L2 via the power supply means J4, however, the magnetic poles P3 and P4 of the magnetic member B2 are magnetized with the south and north magnetic poles. In this case, since the edges a of the south and north magnetic poles of the double-pole permanent magnet M2 lie opposite to the magnetic poles P3 and P4, a large clockwise torque is created in the double-pole permanent magnet M2 owing to repulsion between its north magnetic pole and the north-magnetized pole P4 and between its south magnetic pole and the south-magnetized pole P3. In consequence, a clockwise torque is produced in the rotor R, turning it clockwise.

When the rotor R thus turns clockwise and if it further rotates in excess of 45 degrees from the fourth state, since the north and south magnetic poles of the double-pole permanent magnet M1 remain in the opposing relation to the magnetic poles P1 and P2 of the magnetic member B1 now magnetized with the south and north magnetic poles, no torque is yielded in the double-pole permanent magnet M1, or even if generated, it is only a shall counterclockwise torque. However, since the north and south magnetic poles of the double-pole permanent magnet M2 approach the magnetic poles P3 and P4 now magnetized with the south and north magnetic poles, a large clockwise torque is generated in the double-pole permanent magnet M2 by virtue of attraction between its north magnetic pole and the south-magnetized pole P3 and between its south magnetic pole and the north-magnetized pole P4. As a result of this, the rotor R turns clockwise.

When the rotor R thus turns clockwise and if it further rotates in excess of 90 degrees from the fourth state, the north and south magnetic poles of the double-pole permanent magnet M2 turn into opposing relation to the magnetic poles P3 and P4 of the magnetic member B2 now magnetized with the south and north magnetic poles, no torque is developed in the double-pole permanent magnet M2, or even if produced, it is only a small clockwise torque. However, since the north and south magnetic poles of the double-pole permanent magnet M1 stay out of opposing relation to the magnetic poles P1 and P2 now magnetized with the south and north magnetic poles, there is produced in the double-pole permanent magnet M1 a large torque which prevents the rotor R from rotating clockwise in excess of 90 degrees from the fourth state. Therefore, the rotor R does not turn clockwise in excess of 90 degrees from the fourth state.

For the reason given above, when supplying power to the exciting windings L1 and L2 via the power supply means J2 and J4 in the state in which the display element E assumes the fourth state, it is switched to and held in the first state.

When the display element E is in the fourth state, if power is supplied via the power supply means J1 to the exciting winding L1 and to the exciting winding L2 via the power supply means J4 for a very short time as shown in FIG. 10, the rotor R of the motor mechanism Q will assume the second rotational position, where the display element E is switched to and held in the second state in which its display surface F2 faces front.

The reason for this is as follows:

Let it be assumed that power is supplied first to the exciting winding L1 via the power supply means J1 and then to the exciting winding L2 via the power supply means J4 after a little while.

In such a case, the power supply to the exciting winding L1 via the power supply means J1 magnetizes the magnetic poles P1 and P2 of the magnetic member B1 with the north and south magnetic poles. In this case, since the edges b of the north and south magnetic poles of the double-pole permanent magnet M1 lie opposite the magnetic poles P1 and P2, a large counterclockwise torque is produced in the double-pole permanent magnet M1 by repulsion between its north magnetic pole and the north-magnetized pole P1 and between its south magnetic pole and the south-magnetized pole P2. In consequence, a counter-clockwise torque occurs in the rotor R, driving it counterclockwise.

When the rotor R thus turns counterclockwise and if it further rotates in excess of 45 degrees from the fourth rotational position, the north and south magnetic poles of the double-pole permanent magnet M1 approach the magnetic poles P2 and P1 now magnetized with the south and north magnetic poles. This develops a large counterclockwise torque in the double-pole permanent magnet M1 by virtue of attraction between its north magnetic pole and the south-magnetized pole P2 and between its south magnetic pole and the north-magnetized pole P1.

Further, if power is supplied to the exciting winding L2 via the power supply means J4 at exactly or substantially the same instant when the rotor R has just turned counterclockwise more than 45 degrees from the fourth rotational position, then the magnetic poles P4 and P3 of the magnetic member B2 will be magnetized with the north and south magnetic poles immediately. In this case, the north and south magnetic poles of the double-pole permanent magnet M2 lie in opposing relation to the magnetic poles P4 and P3, generating a counterclockwise torque in the double-pole permanent magnet M2 by virtue of repulsion between its north magnetic pole and the north-magnetized pole P4 and between its south magnetic pole and the south-magnetized pole P3. As a result of this, the rotor R turns counterclockwise.

When the rotor R thus turns counterclockwise and if it further turns in excess of 90 degrees from the fourth rotational position, the edges a of north and south magnetic poles of the double-pole permanent magnet member M1 enter into opposing relation to the magnetic poles P2 and P1 of the magnetic member B1 now magnetized with the south and north magnetic poles, so that no torque is created in the double-pole permanent magnet member M1, or even if generated, it is only a small counterclockwise torque. In this instance, however, since the edges b of the north and south magnetic poles of the double-pole permanent magnet member M2 are opposite the magnetic poles P4 and P3 of the magnetic member B2 now magnetized with north and south magnetic poles, a large counterclockwise torque is yielded in the double-pole permanent magnet member M2 by repulsion between its north magnetic pole and the north-magnetized pole P4 and between its south magnetic pole and the south-magnetized pole P3. On this account, a large counterclockwise torque develops in the rotor R, turning it counterclockwise.

When the rotor R thus turns counterclockwise and if it further rotates in excess of 135 degrees from the fourth rotational position, the north and south magnetic poles of the double-pole permanent magnet M1 remain in the opposing relation to the magnetic poles P2 and P1 of the magnetic member B1 now magnetized with the south and north magnetic poles, so that no torque is developed in the double-pole permanent magnet M1, or even if produced, it is only a small clockwise torque. However, since the north and south magnetic poles of the double-pole permanent magnet M2 approach the magnetic poles P3 and P4 now magnetized with the south and north magnetic poles, a large counterclockwise torque is generated in the double-pole permanent magnet M2 by virtue of attraction between its north magnetic pole of the double-pole and the south magnetized pole P3 and between its south magnetic pole and the north-magnetized pole P4. As a result of this, the rotor R turns counter-clockwise.

When the rotor R thus turns counterclockwise and if it further rotates in excess of 180 degrees from the fourth rotational position, the north and south magnetic poles of the double-pole permanent magnet M2 turn into opposing relation to the magnetic poles P3 and P4 of the magnetic member B2 now magnetized with the south and north magnetic poles, and consequently, no torque s developed in the double-pole permanent magnet M2, or even if produced, it is only a small counterclockwise torque. However, since the north and south magnetic poles of the double-pole permanent magnet M1 do not face the magnetic poles P2 and P1 now magnetized with the south and north magnetic poles, there is produced in the double-pole permanent magnet M1 a large torque which prevents the rotor R from rotating counterclockwise in excess of 180 degrees from the fourth state. Therefore, the rotor R does not turn counterclockwise in excess of 180 degrees from the fourth rotational position.

The above description has been given of the case where power is supplied first to the exciting winding L1 via the power supply means J1 and then to the exciting winding L2 via the power supply means J4 a little after the above power supply, but in the opposite case, the rotor R turns by 180 degrees from the fourth rotational position in the clockwise direction reverse from that in the above, though not described in detail.

For the reason given above, when supplying power to the exciting windings L1 and L2 via the power supply means J1 and J4 when the display element E is in the fourth state, it is switched to and held in the second state.

When the display element E is in the fourth state, if power is supplied to the exciting winding L1 via the power supply means J1 and to the exciting winding L2 via the power supply means J3 for a very short time at about the same time as shown in FIG. 11, the rotor R of the motor mechanism Q will assume the third rotational position, where the display element E is switched to and held in the third state in which its display surface F3 faces front.

The reason for this is as follows:

By the power supply to the exciting winding L2 via the power supply means J3, the magnetic poles P3 and P4 of the magnetic member B2 are magnetized with the north and south magnetic poles. In this case, however, since the edges a of the south and north magnetic poles of the double-pole permanent magnet member M2 are opposite the magnetic poles P3 and P4, no torque is produced in the double-pole permanent magnet member M2, or even if produced, it is only a small counterclockwise torque. By the power supply to the exciting winding L1 via the power supply means J1, however, the magnetic poles P1 and P2 of the magnetic member B1 are magnetized with the north and south magnetic poles. In this case, since the edges b of the north and magnetic poles of the double-pole permanent magnet M1 lie opposite the magnetic poles P1 and P2, a large counterclockwise torque is produced in the double-pole permanent magnet M1 by repulsion between its north magnetic pole and the north-magnetized pole P1 and between its south magnetic pole and the-south magnetized pole P2. In consequence, a counterclockwise torque is produced in the rotor R, urging it to turn counterclockwise.

When the rotor R thus turns counterclockwise and if it further rotates in excess of 45 degrees from the fourth rotational position, the north and south magnetic poles of the double-pole permanent magnet M2 remain in the opposing relation to the magnetic poles P4 and P3 of the magnetic member B2 now magnetized with the south and north magnetic poles, and hence no torque is produced in the double-pole permanent magnet M2, or even if generated, it is only a small clockwise torque. However, since the north and south magnetic poles of the double-pole permanent magnet M1 approach the magnetic poles P2 and P1 now magnetized with the south and north magnetic poles, a large counterclockwise torque is generated in the double-pole permanent magnet M1 by virtue of attraction between its north magnetic pole and the south-magnetized pole P2 and between its south magnetic pole and the north-magnetized pole P1. As a result of this, the rotor R turns counterclockwise.

When the rotor R thus turns counterclockwise and if it further rotates counterclockwise in excess of 90 degrees from the fourth rotational position, the north and south magnetic poles of the double-pole permanent magnet M1 turn into opposing relation to the magnetic poles P2 and P1 of the magnetic member B1 now magnetized with the south and north magnetic poles, so that no torque is developed in the double-pole permanent magnet M1, or even if produced, it is only a small counterclockwise torque. However, since the north and south magnetic poles of the double-pole permanent magnet M2 turn out of opposing relation to the magnetic poles P4 and P3 now magnetized with the south and north magnetic poles, there is produced in the double-pole permanent magnet M2 a large torque which prevents the rotor R from rotating counter-clockwise in excess of 90 degrees from the fourth rotational position. Therefore, the rotor R does not turn counterclockwise in excess of 90 degrees from the fourth rotational position.

For the reason given above, when supplying power to the exciting windings L1 and L2 via the power supply means J1 and J3 when display element E is in the fourth state, it is switched to and held in the third state.

Now, let it be assumed that the rotor R of the motor mechanism lies at the second rotational position where the display element E is in the second state in which the display surface F2 of the display surface member D faces to the front. In such a second state of the display element E, even if power is supplied via the power supply means J1 to the exciting winding L1 of the stator S of the motor mechanism Q and to the exciting winding L2 via the power supply means J4 for a very short time at about the same time, as shown in FIG. 10, the display element E will remain in the second state.

The reason for this is as follows:

By the power supply to the exciting winding L1 via the power supply means J1, the magnetic poles P1 and P2 of the magnetic member B1 are magnetized with the north and south magnetic poles to produce a small clockwise torque in the double-pole permanent magnet member M1, urging the rotor R to rotate clockwise. By the power supply to the exciting winding L2 via the power supply means J4, however, the magnetic poles P3 and P4 of the magnetic member B2 are magnetized with the south and north magnetic poles to produce a small counterclockwise torque in the double-pole permanent magnet member M2, urging the rotor R to rotate counterclockwise. Accordingly, there develops in the rotor R no torque, or only a small counterclockwise or clockwise torque. In the case where the small clockwise torque is produced in the rotor R, the south and north magnetic poles of the double-pole permanent magnet member M1 remain in the opposing relation to the magnetic poles P1 and P2 of the magnetic member B1 now magnetized with the north and south magnetic poles, so that there does not develop in the double-pole permanent magnet member M1 a torque which prevents the rotor R from rotating clockwise. However, since the north and south magnetic poles of the double-pole permanent magnet member M2 turn out of the opposing relation to the magnetic poles P3 and P4 of the magnetic member B2 now magnetized with the south and north magnetic poles, there is produced in the double-pole permanent magnet member M2 a torque which prevents clockwise rotational movement of the rotor R. Further, in the case where the above-said small counterclockwise torque is produced in the rotor R, the north and south magnetic poles of the double-pole permanent magnet member M2 do not turn out of the opposing relation to the magnetic poles P3 and P4 now magnetized with the south and north magnetic poles, so that there does not develop in the double-pole permanent magnet member M2 a torque which prevents the rotor R from rotating counterclockwise. However, since the north and south magnetic poles of the double-pole permanent magnet member M1 get out of the opposing relation to the magnetic poles P2 and P1 now magnetized with the south and north magnetic poles, there is produced in the double-pole permanent magnet member M1 a torque which prevents the counterclockwise rotational movement of the rotor R.

For the reason given above, even if power is supplied to the exciting windings L1 and L2 via the power supply means J1 and J4 when the display element E is in the second state, it will remain in that state.

When the display element E is in the second state, if power is supplied via the power supply means J2 to the exciting winding L1 and to the exciting winding L2 via the power supply means J4 for a very short time at about the same time, as shown in FIG. 8, the rotor R of the motor mechanism Q will assume the first rotational position, where the display element E is switched to and held in the first state in which its display surface F1 faces front.

The reason for this is as follows:

By the power supply to the exciting winding L2 via the power supply means J4, the magnetic poles P3 and P4 of the magnetic member B2 are magnetized with the south and north magnetic poles. In this case, however, since the edges a of the north and south magnetic poles of the double-pole permanent magnet member M2 are opposite the magnetic poles P3 and P4, no torque is produced in the double-pole permanent magnet member M2, or even if produced, it is only a small counterclockwise torque. By the power supply to the exciting winding L1 via the power supply means J2, however, the magnetic poles P1 and P2 of the magnetic member B1 are magnetized with the south and north magnetic poles. In this case, since the edges b of the south and north magnetic poles of the double-pole permanent magnet M1 lie opposite the magnetic poles P1 and P2, a large counterclockwise torque is produced in the double-pole permanent magnet M1 by repulsion between its north magnetic pole and the north magnetized pole P2 and between its south magnetic pole and the south-magnetized pole P1. In consequence, a counterclockwise torque is produced in the rotor R, driving it counterclockwise.

When the rotor R thus turns counterclockwise and if it further rotates in excess of 45 degrees from the second rotational position, the north and south magnetic poles of the double-pole permanent magnet M2 remain in the opposing relation to the magnetic poles P3 and P4 of the magnetic member B2 now magnetized with the south and north magnetic poles, and hence no torque is produced in the double-pole permanent magnet M2, or even if generated, it is only a small clockwise torque. However, since the north and south magnetic poles of the double-pole permanent magnet M1 approach the magnetic poles P1 and P2 now magnetized with the south and north magnetic poles, a large counterclockwise torque is generated in the double-pole permanent magnet M1 by virtue of attraction between its north magnetic pole and the south-magnetized pole P1 and between its south magnetic pole and the north-magnetized pole P2. As a result of this, the rotor R turns counterclockwise.

When the rotor R thus turns counterclockwise and if it further rotates counterclockwise in excess of 90 degrees from the second rotational position, the north and south magnetic poles of the double-pole permanent magnet M1 turn into opposing relation to the magnetic poles P1 and P2 of the magnetic member B1 now magnetized with the south and north magnetic poles, and consequently, no torque is developed in the double-pole permanent magnet M1, or even if produced, it is only a small counterclockwise torque. However, since the north and south magnetic poles of the double-pole permanent magnet M2 get out of opposing relation to the magnetic poles P3 and P4 now magnetized with the south and north magnetic poles, there is produced in the double-pole permanent magnet M2 a large torque which prevents the rotor R from rotating counterclockwise in excess of 90 degrees from the second rotational position. Therefore, the rotor R does not turn counterclockwise in excess of 90 degrees from the second rotational position.

For the reason given above, when supplying power to the exciting windings L1 and L2 via the power supply means J2 and J4 when the display element E is in the second state, it is switched to and held in the first state.

When the display element E is in the second state, if power is supplied via the power supply means J2 to the exciting winding L1 and to the exciting winding L2 via the power supply means J3 for a very short time, as shown in FIG. 19, the rotor R of the motor mechanism Q will assume the fourth rotational position, where the display element E is switched to and held in the state in which its display surface F4 faces front.

The reason for this is as follows:

Let it be assumed that power is supplied to the exciting winding L1 via the power supply means J2 and then to the exciting winding L2 via the power supply means J3 a little after the start of the former power supply.

In such a case, by the power supply to the exciting winding L1 via the power supply means J2, the magnetic poles P1 and P2 of the magnetic member B1 are magnetized with the south and north magnetic poles. In this case, the edges b of the south and north and magnetic poles of the double-pole permanent magnet M1 lie opposite the magnetic poles P1 and P2, a large counterclockwise torque is produced in the double-pole permanent magnet M1 by repulsion between its north magnetic pole and the north-magnetized pole P2 and between its south magnetic pole and the south-magnetized pole P1. In consequence, a counter-clockwise torque is produced in the rotor R, driving it counterclockwise.

When the rotor R thus turns counterclockwise and if it further rotates in excess of 45 degrees from the second state, the north and south magnetic poles of the double-pole permanent magnet M1 approach the magnetic poles P1 and P2 now magnetized with the south and north magnetic poles, and consequently, a large counterclockwise torque is generated in the double-pole permanent magnet M1 by virtue of attraction between its north magnetic pole and the south magnetized pole P1 and between its south magnetic pole and the north magnetized pole P2.

Further, if power is supplied to the exciting winding L2 via the power supply means J3 at exactly or nearly the same instant when the rotor R has just turned counterclockwise more than 45 degrees from the second rotational position, then the magnetic poles P3 and P4 of the magnetic member B2 will be magnetized with the north and magnetic poles immediately. In this case, since the north and south magnetic poles of the double-pole permanent magnet M2 lie in opposing relation to the magnetic poles P3 and P4, a large counterclockwise torque is generated in the double-pole permanent magnet M2 by virtue of repulsion between its north magnetic pole and the north-magnetized pole P3 and between its south magnetic pole and the south-magnetized pole P4. As a result of this, the rotor R turns counterclockwise.

When the rotor R thus turns counterclockwise and if it further rotates in excess of 90 degrees from the second rotational position, the edges a of the north and south magnetic poles of the double-pole permanent magnet M1 turn into opposing relation to the magnetic poles P1 and P2 of the magnetic member B1 now magnetized with the south and north magnetic poles, and consequently, no torque is developed in the double-pole permanent magnet M1, or even if produced, it is only a small counterclockwise torque. However, since the edges b of the north and south magnetic poles of the double-pole permanent magnet M2 are in opposing relation to the magnetic poles P3 and P4 now magnetized with the north and south magnetic poles, there is produced in the double-pole permanent magnet M2 a large counterclockwise torque by repulsion between its north magnetic pole and the north-magnetized pole P3 and between its south magnetic pole and the south-magnetized pole P4. In consequence, a counterclockwise torque is produced in the rotor R, driving it counterclockwise.

When the rotor R thus turns counterclockwise and if it further rotates in excess of 135 degrees from the second rotational position, the north and south magnetic poles of the double-pole permanent magnet M1 remain in the opposing relation to the magnetic poles P1 and P2 of the magnetic member B1 now magnetized with the south and north magnetic poles, and consequently, no torque is produced in the double-pole permanent magnet M1, or even if generated, it is only a small clockwise torque. However, since the north and south magnetic poles of the double-pole permanent magnet M2 approach the magnetic poles P4 and P3 now magnetized with the south and north magnetic poles, a large counterclockwise torque is generated in the double-pole permanent magnet M2 by virtue of attraction between its north magnetic pole and the south-magnetized pole P4 and between its south magnetic pole and the north-magnetized pole P3. As a result of this, the rotor R turns counter-clockwise.

When the rotor R thus turns counterclockwise and if it further rotates in excess of 180 degrees from the second rotational position, the north and south magnetic poles of the double-pole permanent magnet M2 turn into opposing relation to the magnetic poles P4 and P3 of the magnetic member B2 now magnetized with the south and north magnetic poles, and consequently, no torque is developed in the double-pole permanent magnet M2, or even if produced, it is only a small counterclockwise torque. However, since the north and south magnetic poles of the double-pole permanent magnet M1 leave the magnetic poles P1 and P2 now magnetized with the south and north magnetic poles, there is produced in the double-pole permanent magnet M1 a large torque which prevents the rotor R from rotating counterclockwise in excess of 180 degrees from the second state. Therefore, the rotor R does not turn counterclockwise in excess of 180 degrees from the second rotational position.

The above description has been given of the case where the power supply to the exciting winding L1 via the power supply means J2 is followed by the power supply to the exciting winding L2 via the power supply means J3 after a very short time interval, but in the opposite case, the rotor R turns by 180 degrees from the second rotational position in the clockwise direction reverse from that in the above, though not described in detail.

For the reason given above, when supplying power to the exciting windings L1 and L2 via the power supply means J2 and J3 when the display element E is in the second state, it is switched to and held in the fourth state.

When the display element E is in the second state, if power is supplied via the power supply means J1 to the exciting winding L1 and to the exciting winding L2 via the power supply means J3 for a very short time at about the same time, as shown in FIG. 11, the rotor R of the motor mechanism Q will assume the third rotational position, where the display element E is switched to and held in the third state in which its display surface F3 faces front.

The reason for this is as follows:

By the power supply to the exciting winding L1 via the power supply means J1, the magnetic poles P1 and P2 of the magnetic member B1 are magnetized with the north and south magnetic poles. In this case, since the edges b of the south and north magnetic poles of the double-pole permanent magnet member M1 are opposite the magnetic poles P1 and P2, no torque is produced in the double-pole permanent magnet member M1, or even if produced, it is only a small clockwise torque. By the power supply to the exciting winding L2 via the power supply means J3, however, the magnetic poles P3 and P4 of the magnetic member B2 are magnetized with the north and south magnetic poles. In this case, since the edges a of the north and magnetic poles of the double-pole permanent magnet M2 lie opposite to the magnetic poles P3 and P4, a large clockwise torque is produced in the double-pole permanent magnet M2 by repulsion between its north magnetic pole and the north magnetized pole P3 and between its south magnetic pole and the south-magnetized pole P4. In consequence, a clockwise torque is produced in the rotor R, driving it clockwise.

When the rotor R thus turns clockwise and if it further rotates in excess of 45 degrees from the second rotational position, the north and south magnetic poles of the double-pole permanent magnet M1 remain in the opposing relation to the magnetic poles P2 and P1 of the magnetic member B1 now magnetized with the south and north magnetic poles. At this time, no torque is produced in the double-pole permanent magnet M1, or even if generated, it is only a small counterclockwise torque. However, since the north and south magnetic poles of the double-pole permanent magnet M2 approach the magnetic poles P4 and P3 now magnetized with the south and north magnetic poles, a large clockwise rotating torque is generated in the double-pole permanent magnet M2 by virtue of attraction between its north magnetic pole and the south-magnetized pole P4 and between its south magnetic pole and the north-magnetized pole P3. As a result of this, the rotor R turns clockwise.

When the rotor R thus turns clockwise and if it further rotates in excess of 90 degrees from the second rotational position, the edges b of the north and south magnetic poles of the double-pole permanent magnet M2 turn into opposing relation to the magnetic poles P4 and P3 of the magnetic member B2 now magnetized with the south and north magnetic poles. At this time, no torque is developed in the double-pole permanent magnet M2, or even if produced, it is only a small clockwise torque. However, since the north and south magnetic poles of the double-pole permanent magnet M1 turn out of opposing relation to the magnetic poles P2 and P1 now magnetized with the south and north magnetic poles, there is produced in the double-pole permanent magnet M1 a large torque which prevents the rotor R from rotating clockwise in excess of 90 degrees from the second state. Therefore, the rotor R does not turn clockwise in excess of 90 degrees from the second rotational position.

For the reason given above, when supplying power to the exciting windings L1 and L2 via the power supply means J1 and J3 when the display element E in the second state, it is switched to and held in the third state.

Now, let it be assumed that the rotor R of the motor mechanism lies at the third rotational position, and consequently, the display element E is in the third state in which the display surface F3 of the display surface member D faces to the front. In such a third state of the display element E, even if power is supplied via the power supply means J1 to the exciting winding L1 of the stator S of the motor mechanism Q and to the exciting winding L2 via the power supply means J3 for a very short time a little before or after each other, as shown in FIG. 11, the display element E will remain in the third state.

The reason of this is as follows:

By the power supply to the exciting winding L1 via the power supply means J1, the magnetic poles P1 and P2 of the magnetic member B1 are magnetized with the north and south magnetic poles to produce a small counterclockwise torque in the double-pole permanent magnet member M1, urging the rotor R to rotate counterclockwise. By the power supply to the exciting winding L2 via the power supply means J3, however, the magnetic poles P3 and P4 of the magnetic member B2 are magnetized with the north and south magnetic poles to produce a small clockwise torque in the double-pole permanent magnet member M2, urging the rotor R to rotate clockwise. Accordingly, there develops in the rotor R no torque, or only a small counterclockwise or clockwise torque.

In the case where the small clockwise torque is produced in the rotor R, since the north and south magnetic poles of the double-pole permanent magnet member M2 remain in the opposing relation to the magnetic poles P4 and P3 of the magnetic member B2 now magnetized with the south and north magnetic poles, there does not develop in the double-pole permanent magnet member M2 a torque which prevents the rotor R from rotating clockwise. However, since the north and south magnetic poles of the double-pole permanent magnet member M1 turn out of the opposing relation to the magnetic poles P2 and P1 of the magnetic member B1 now magnetized with the south and north magnetic poles, there is produced in the double-pole permanent magnet member M1 a torque which prevents clockwise rotational movement of the rotor R. Further, in the case where the small counter-clockwise torque is produced in the rotor R, since the north and south magnetic poles of the double-pole permanent magnet member M1 do not turn out of the opposing relation to the magnetic poles P2 and P1 magnetized with the south and north magnetic poles, there does not develop in the double-pole permanent magnet member M1 a torque which prevents the rotor R from rotating counterclockwise. However, since the north and south magnetic poles of the double-pole permanent magnet member M2 get out of the opposing relation to the magnetic poles P4 and P3 of the magnetic member B2 magnetized with the south and north magnetic poles, there is produced in the double-pole permanent magnet member M2 a torque which prevents the counterclockwise rotational movement of the rotor R.

For the reason given above, even if power is supplied to the exciting windings L1 and L2 via the power supply means J1 and J3 when the display element E is in the third state, it will remain in that state.

When the display element E is in the third state, if power is supplied via the power supply means J2 to the exciting winding L1 for a very short time and power is supplied to the exciting winding L2 via the power supply means J4 for a very short time a little before or after the start of the former power supply, as shown in FIG. 8, the rotor R of the motor mechanism Q will assume the first rotational position, where the display element E is switched to and held in the first state in which its display surface F1 faces to the front.

The reason for this is as follows:

Let it be assumed that the power supply to the exciting winding L1 via the power supply means J2 slightly precedes the power supply to the exciting winding L2 via the power supply means J4.

By the power supply to the exciting winding L1 via the power supply means J2, the magnetic poles P1 and P2 of the magnetic member B1 are magnetized with the south and north magnetic poles. In this case, since the edges a of the south and north magnetic poles of the double-pole permanent magnet M1 lie opposite the magnetic poles P1 and P2, a large clockwise torque is produced in the double-pole permanent magnet M1 by repulsion between its north magnetic pole and the north-magnetized pole P2 and between its south magnetic pole and the south-magnetized pole P1. In consequence, a clockwise torque is produced in the rotor R, driving it clockwise.

When the rotor R thus turns clockwise and if it further rotates in excess of 45 degrees from the third rotational position, the north and south magnetic poles of the double-pole permanent magnet M1 approach the magnetic poles P1 and P2 now magnetized with the south and north magnetic poles, a large clockwise torque is generated in the double-pole permanent magnet M1 by virtue of attraction between its north magnetic pole and the south-magnetized pole P1 and between its south magnetic pole and the north-magnetized pole P2.

Further, if the power supply to the exciting winding L2 via the power supply means J4 is effected at or in the vicinity of the point of time when the rotor R has just turned clockwise more than 45 degrees from the third rotational position, then the magnetic poles P3 and P4 of the magnetic member B2 will be magnetized with the south and north magnetic poles immediately. In this case, since the south and north magnetic poles of the double-pole permanent magnet M2 lie in opposing relation to the magnetic poles P3 and P4, a clockwise torque is generated in the double-pole permanent magnet M2 by virtue of repulsion between its north magnetic pole and the north magnetized pole P4 and between its south magnetic pole and the south-magnetized pole P3. As a result of this, the rotor R turns clockwise.

When the rotor R thus turns clockwise and if it further rotates in excess of 90 degrees from the third rotational position, the edges b of the north and south magnetic poles of the double-pole permanent magnet M1 turn into opposing relation to the magnetic poles P1 and P2 of the magnetic member B1 now magnetized with the south and north magnetic poles. Therefore, no rotating torque is developed in the double-pole permanent magnet M1, or even if produced, it is only a small clockwise torque. However, since the edges a of the north and south magnetic poles of the double-pole permanent magnet M2 are opposing relation to the magnetic poles P4 and P3 now magnetized with the north and south magnetic poles, there is produced in the double-pole permanent magnet M2 a large clockwise torque by repulsion between its north magnetic pole and the north magnetized pole P4 and between its south magnetic pole and the south-magnetized pole P3. In consequence, a clockwise torque is produced in the rotor R, driving it clockwise.

When the rotor R thus turns clockwise and if it further rotates in excess of 135 degrees from the third rotational position, the north and south magnetic poles of the double-pole permanent magnet M1 remain in the opposing relation to the magnetic poles P1 and P2 of the magnetic member B1 now magnetized with the south and north magnetic poles. Therefore, no torque is produced in the double-pole permanent magnet M1, or even if generated, it is only a small counterclockwise torque. However, since the north and south magnetic poles of the double-pole permanent magnet M2 approach the magnetic poles P3 and P4 now magnetized with the south and north magnetic poles, a large clockwise torque is generated in the double-pole permanent magnet M2 by virtue of attraction between its north magnetic pole and the south-magnetized pole P3 and between its south magnetic pole and the north-magnetized pole P4. As a result of this, the rotor R turns clockwise.

When the rotor R thus turns clockwise and if it further rotates in excess of 180 degrees from the third rotational position, the north and south magnetic poles of the double-pole permanent magnet M2 turn into opposing relation to the magnetic poles P3 and P4 of the magnetic member B2 now magnetized with the south and north magnetic poles. Therefore, no torque is developed in the double-pole permanent magnet M2, or even if produced, it is only a small clockwise torque. However, since the north and south magnetic poles of the double-pole permanent magnet M1 turn out of opposing relation to the magnetic poles P1 and P2 now magnetized with the south and north magnetic poles, there is produced in the double-pole permanent magnet M1 a large torque which prevents the rotor R from rotating clockwise in excess of 180 degrees from the third rotational position. Accordingly, the rotor R does not turn clockwise in excess of 180 degrees from the third state.

The above description has been given of the case where the power supply to the exciting winding L1 via the power supply means J2 slightly precedes the power supply to the exciting winding L2 via the power supply means J4. On the other hand, when the power supply to the exciting winding L2 via the power supply means J4 slightly precedes the power supply to the exciting winding L1 via the power supply means J2, the rotor R turns by 180 degrees from the third rotational position in the counterclockwise direction reverse from that in the above, though not described in detail.

For the reason given above, when supplying power to the exciting windings L1 and L2 via the power supply means J2 and J4 when the display element E is in the third state, it is switched to and held in the first state.

When the display element E is in the third state, if power is supplied via the power supply means J2 to the exciting winding L1 for a very short time and power is supplied to the exciting winding L2 via the power supply means J3 for a very short time a little before or after the start of the former power supply, as shown in FIG. 9, the rotor R of the motor mechanism Q will assume the fourth rotational position, by which the display element E is switched to the fourth state in which its display surface F4 faces front, thereafter being held in that state.

The reason for this is as follows:

By the power supply to the exciting winding L2 via the power supply means J3, the magnetic poles P3 and P4 of the magnetic member B2 are magnetized with the north and south magnetic poles. In this case, however, since the edges b of the south and north magnetic poles of the double-pole permanent magnet member M2 are opposite the magnetic poles P3 and P4, no torque is produced in the double-pole permanent magnet member M2, or even if produced, it is only a small clockwise torque. By the power supply to the exciting winding L1 via the power supply means J2, however, the magnetic poles P1 and P2 of the magnetic member B1 are magnetized with the south and north magnetic poles. In this case, since the edges a of the south and north magnetic poles of the double-pole permanent magnet M1 lie opposite to the magnetic poles P1 and P2, a large clockwise torque is produced in the double-pole permanent magnet M1 by repulsion between its north magnetic pole and the north magnetized pole P2 and between its south magnetic pole and the south-magnetized pole P1. In consequence, a clockwise torque is produced in the rotor R, driving it clockwise.

When the rotor R thus turns clockwise and if it further rotates in excess of 45 degrees from the third rotational position, the north and south magnetic poles of the double-pole permanent magnet M2 remain in the opposing relation to the magnetic poles P4 and P3 of the magnetic member B2 now magnetized with the south and north magnetic poles. Therefore, no torque is produced in the double-pole permanent magnet M2, or even if generated, it is only a small counterclockwise torque. However, since the north and south magnetic poles of the double-pole permanent magnet M1 approach the magnetic poles P1 and P2 now magnetized with the south and north magnetic poles, a large clockwise torque is generated in the double-pole permanent magnet M1 by virtue of attraction between its north magnetic pole and the south- 0 magnetized pole P1 and between its south magnetic and the north-magnetized pole P2. As a result of this, the rotor R turns clockwise.

When the rotor R thus turns clockwise and if it further rotates in excess of 90 degrees from the third rotational position, the north and south magnetic poles of the double-pole permanent magnet M1 turn into opposing relation to the magnetic poles P1 and P2 of the magnetic member B1 now magnetized with the south and north magnetic poles. Therefore, no torque is developed in the double-pole permanent magnet M1, or even if produced, it is only a small clockwise torque. However, since the north and south magnetic poles of the double-pole permanent magnet M2 turn out of opposing relation to the magnetic poles P4 and P3 now magnetized with the south and north magnetic poles, there is produced in the double-pole permanent magnet M2 a large torque which prevents the rotor R from rotating clockwise in excess of 90 degrees from the third rotational position. On this account, the rotor R does not turn clockwise in excess of 90 degrees from the third rotational position.

For the reason given above, when supplying power to the exciting windings L1 and L2 via the power supply means J2 and J3 when the display element E is in the third state, it is switched to and held in the fourth state.

When the display element E is in the third state, if power is supplied via the power supply means J1 to the exciting winding L1 for a very short time and power is also supplied to the exciting winding L2 via the power supply means J4 for a very short time a little before or after the start of the former power supply, as shown in FIG. 10, the rotor R of the motor mechanism Q will assume the second rotational position, by which the display element E is switched to the second state in which its display surface F2 faces to the front, thereafter being held in the second state.

The reason for this is as follows:

By the power supply to the exciting winding L1 via the power supply means J1, the magnetic poles P1 and P2 of the magnetic member B1 are magnetized with the north and south magnetic poles. In this case, however, since the edges a of the south and north magnetic poles of the double-pole permanent magnet member M1 are opposite to the magnetic poles P1 and P2, no torque is produced in the double-pole permanent magnet member M1, or even if produced, it is only a small counterclockwise torque. By the power supply to the exciting winding L2 via the power supply means J4, however, the magnetic poles P3 and P4 of the magnetic member B2 are magnetized with the south and north magnetic poles. In this case, since the edges b of the south and north magnetic poles of the double-pole permanent magnet M2 lie opposite to the magnetic poles P3 and P4, a large counter-clockwise torque is produced in the double-pole permanent magnet M2 by repulsion between its north magnetic pole and the north-magnetized pole P4 and between its south magnetic pole and the south-magnetized pole P3. In consequence, a counterclockwise torque is produced in the rotor R, driving it counterclockwise.

When the rotor R thus turns counterclockwise and if it further rotates in excess of 45 degrees from the third rotational position, the north and south magnetic poles of the double-pole permanent magnet M1 remain in the opposing relation to the magnetic poles P2 and P1 of the magnetic member B1 now magnetized with the south and north magnetic poles. Therefore, no torque is produced in the double-pole permanent magnet M1, or even if generated, it is only a small clockwise torque. However, since the north and south magnetic poles of the double-pole permanent magnet M2 approach the magnetic poles P3 and P4 now magnetized with the south and north magnetic poles, a large counterclockwise torque is generated in the double-pole permanent magnet M2 by virtue of attraction between its north magnetic pole and the south-magnetized pole P3 and attractive force between its south magnetic pole and the north-magnetized pole P4. As a result of this, the rotor R turns clockwise.

When the rotor R thus turns counterclockwise and if it further rotates in excess of 90 degrees from the third rotational position, the edges a of the north and south magnetic poles of the double-pole permanent magnet M2 are opposing relation to the magnetic poles P3 and P4 of the magnetic member B2 now magnetized with the south and north magnetic poles. Therefore, no torque is developed in the double-pole permanent magnet M2, or even if produced, it is only a small counterclockwise torque. However, since the edges b of the north and south magnetic poles of the double-pole permanent magnet M1 turn out of opposing relation to the magnetic poles P2 and P1 now magnetized with the south and north magnetic poles, there is produced in the double-pole permanent magnet M1 a large torque which prevents the rotor R from rotating counterclockwise in excess of 90 degrees from the third rotational position. On this account, the rotor R does not turn counterclockwise in excess of 90 degrees from the third rotational position.

For the reason given above, when supplying power to the exciting windings L1 and L2 via the power supply means J1 and J4 when the display element E is in the third state, it is switched to and held in the second state.

As will be appreciated from the foregoing description, according to the present invention, the display surfaces F1, F4, F2 and F3 of the display surface member D of the display element E can selectively be directed to the front simply by selecting operations of:

(i) Supplying power to the exciting winding L1 via the power supply means J2 and supplying power to the exciting winding L2 via the power supply means J4 a little before or after the above power supply;

(ii) Supplying power to the exciting winding L1 via the power supply means J2 and supplying power to the exciting winding L2 via the power supply means J3 a little before or after the above power supply;

(iii) Supplying power to the exciting winding L1 via the power supply means J1 and supplying power to the exciting winding L2 via the power supply means J4 a little before or after the above power supply; and (iv) Supplying power to the exciting winding L1 via the power supply means J1 and supplying power to the exciting winding L2 via the power supply means J3 a little before or after the above power supply.

In the case where a selected one of the display surfaces F1, F2, F3 and F4 of the display surface member D is held in the front display position, even if the power supply to the exciting windings L1 and L2 is turned OFF, the north and south magnetic poles of the double-pole permanent magnet members M1 and M2 of the rotor R act on the magnetic poles P1 and P2 of the magnetic member B1 and the magnetic poles P3 and P4 of the magnetic member B2 of the stator S. Accordingly, the selected display surface can be retained in position, without the necessity of providing any particular means therefor. Further, no power consumption is involved therefor.

Since the motor mechanism Q for turning the display surface member D is housed in the latter, drive mechanism for turning the display surface member D need not be provided separately of the display element E.

The means for selecting a desired one of the display surfaces F1, F2, F3 and F4 of the display surface member D of the display element E is very simple, because it is formed by the power supply means J1 and J2 for the exciting winding L1 of the stator S of the motor mechanism Q and the power supply means J3 and J4 for the exciting winding L2 of the stator S.

Since the first and second magnetic poles P1 and P2 of the first magnetic member B1 and the third and fourth magnetic poles P3 and P4 of the second magnetic member B1 each extend over an angular range of only 45 degrees or less about the rotary shaft 11 of the rotor R, the effective angular ranges of the first to fourth magnetic poles P1–P4 about the rotary shaft 11 of the rotor R are so narrow that a desired one of the display surfaces F1–F4 of the display surface member D can be brought accurately to the front display position rapidly and smoothly.

Further, since the first to fourth magnetic poles P1–P4 of the first and second magnetic members B1 and B2 of the stator S each extend over an angular range of only 45 degrees or less about the rotary shaft 11 of the rotor R as mentioned just above, they can be magnetized over their entire angular ranges with far higher intensity, using the same power supply to the first and second exciting windings L1 and L2, than in the case of the afore-mentioned conventional display element in which the first to fourth magnetic poles each extend over as wide an angular range as about 90 degrees about the rotary shaft of the rotor. Accordingly, a desired one of the display surfaces F1–F4 can be rapidly brought to the front display position with far less power consumption than would be needed for the conventional display element.

The foregoing description should be construed as being merely illustrative of the display unit employing the rotating display element of the present invention and should not be construed as limiting the invention specifically thereto.

For example, the double-pole permanent magnet members M1 and M2 of the rotor R of the motor mechanism Q can be formed as if constituted by a single double-pole permanent magnet member in which its portions divided into two in its axial direction serve as the double-pole permanent magnet members M1 and M2, although no detailed description will be given (In this case, afore-mentioned angle $\alpha$ is 0). With such an arrangement, too, the same operational effects as those described previously can be obtained, though not described in detail.

While the foregoing description has been given of the case where the rotor R is a so-called inner rotor type, it will be seen that the rotor can be formed as an outer rotor type. Moreover, the rotor may also be substituted with the stator, in which case the latter may be substituted with the former.

By assembling a number of display units of the present invention into a panel which has many display elements arranged in a matrix form on a common flat or curved surface, a plurality of display surfaces of the many display elements can selectively be directed to the front, making it possible to display letters, symbols, graphic forms, patterns and so forth on the panel. Accordingly, the present invention can be applied, for example, to an advertising panel, a traffic sign board and the like.

Various other modifications and variations may be effected without departing from the scope of the spirits of the present invention.

What is claimed is:

1. A rotating display element, comprising:

a display surface member having four display surfaces;

and a permanent-magnet type motor mechanism;

wherein the display surface member is mounted on a rotor of the permanent magnet type motor mechanism housed therein;

wherein the display surfaces of the display surface member are arranged side by side around the axis of the rotor;

wherein either one of the rotor and the stator of the permanent magnet type motor mechanism has first and second double-pole permanent magnet members respectively having north and south magnetic poles and disposed side by side in the axial direction of the rotor;

wherein the north and south magnetic poles of the first double-pole permanent magnet member are spaced an angular distance of 180 degrees apart around the axis of the rotor;

wherein the north and south magnetic poles of the second double-pole permanent magnet member are disposed around the axis of the rotor at an angular distance of $\pm\alpha^\circ$ (where $0^\circ \leqq \alpha^\circ < 180^\circ$) from the north and south magnetic poles of the first double-pole permanent magnet member and at an angular distance of 180 degrees from each other;

wherein the other of the rotor and the stator of the permanent magnet type motor mechanism has a first magnetic member provided with first and second magnetic poles which act on the north and south magnetic poles of the first double-pole permanent magnet member, a second magnetic member provided with third and fourth magnetic poles which act on the north and south magnetic poles of the second double-pole permanent magnet member, a first exciting winding wound on the first magnetic member in manner to excite its first and second magnetic poles in reverse polarities, and a second exciting winding wound on the second magnetic member in a manner to excite its third and fourth magnetic poles in reverse polarities;

wherein the first and second magnetic poles of the first magnetic member are disposed around the axis of the rotor at an angular distance of 180 degrees;

wherein the third and fourth magnetic poles of the second magnetic member are disposed around the axis of the rotor at an angular distance of $\pm 90 \pm \alpha$ from the first and second magnetic poles of the first magnetic member and at an angular distance of 180 degrees from each other;

wherein the north and south magnetic poles of the first and second double-pole permanent magnet members each extend over an angular range of approximately 90 degrees about axis of the rotor; and wherein the first and second magnetic poles of the first magnetic member and the third and fourth magnetic poles of the second magnetic member each extend over an angular range of 45 degrees or less about the axis of the rotor.

2. A display unit comprising:

a rotating display element;

and a drive unit for driving the rotating display element;

wherein the rotating display element is provided with a display surface member having four display surfaces, and a permanent magnet type motor mechanism;

wherein the display surface member is mounted on a rotor of the permanent magnet type motor mechanism housed therein;

wherein the four of display surfaces of the display surface member are arranged side by side around the axis of the rotor;

wherein either one of the rotor and the stator of the permanent magnet type motor mechanism has first and second double-pole permanent magnet members respectively having north and south magnetic poles and disposed side by side in the axial direction of the rotor;

wherein the north and south magnetic poles of the first double-pole permanent magnet member are spaced an angular distance of 180 degrees apart around the axis of the rotor;

wherein the north and south magnetic poles of the second double-pole permanent magnet member are disposed around the axis of the rotor at an angular distance of $\pm\alpha°$ (where $0° \leqq \alpha° < 180°$) from the north and south magnetic poles of the first double-pole permanent magnet member and at an angular distance of 180 degrees from each other;

wherein the other of the rotor and the stator of the permanent magnet type motor mechanism has a first magnetic member provided with first and second magnetic poles which act on the north and south magnetic poles of the first double-pole permanent magnet member, a second magnetic member provided with third and fourth magnetic poles which act on the north and south magnetic poles of the second double-pole permanent magnet member, a first exciting winding wound on the first magnetic member in manner to excite its first and second magnetic poles in reverse polarities, and a second exciting winding wound on the second magnetic member in a manner to excite its third and fourth magnetic poles in reverse polarities;

wherein the first and second magnetic poles of the first magnetic member are disposed around the axis of the rotor at an angular distance of 180 degrees;

wherein the third and fourth magnetic poles of the second magnetic member are disposed around the axis of the rotor at an angular distance of $\pm 90 \pm \alpha$ from the first and second magnetic poles of the first magnetic member and at an angular distance of 180 degrees from each other;

wherein the north and south magnetic poles of the first and second double-pole permanent magnet members each extend over an angular range of approximately 90 degrees about axis of the rotor;

wherein the first and second magnetic poles of the first magnetic member and the third and fourth magnetic poles of the second magnetic member each extend over an angular range of 45 degrees or less about the axis of the rotor; and wherein the drive unit has first power supply means for supplying power to the first exciting winding so that the first and second magnetic poles of the first magnetic member are magnetized with the north and south magnetic poles, second power supply means for supplying power to the first exciting winding so that the first and second magnetic poles of the first magnetic member are magnetized with the south and north magnetic poles, third power supply means for supplying power to the second exciting winding so that the third and fourth magnetic poles of the second magnetic member are magnetized with the north and south magnetic poles, and fourth power supply means for supplying power to the second exciting winding so that the third and fourth magnetic poles of the second magnetic member are magnetized with the south and north magnetic poles.

* * * * *